US005170144A

United States Patent [19]

Nielsen

[11] Patent Number: 5,170,144

[45] Date of Patent: Dec. 8, 1992

[54] HIGH EFFICIENCY, FLUX-PATH-SWITCHING, ELECTROMAGNETIC ACTUATOR

[75] Inventor: Wyn Y. Nielsen, La Jolla, Calif.

[73] Assignee: Solatrol, Inc., San Diego, Calif.

[21] Appl. No.: 388,059

[22] Filed: Jul. 31, 1989

[51] Int. Cl.[5] ..... H01F 7/02

[52] U.S. Cl. ..... 335/229; 335/230; 156/272.2

[58] Field of Search ..... 335/234, 238, 229, 236, 335/230, 174; 219/542, 544; 156/272.2

[56] References Cited

U.S. PATENT DOCUMENTS

| | | | |
|---|---|---|---|
| 3,792,390 | 2/1974 | Boyd | 335/229 |
| 4,486,650 | 12/1984 | Bridgstock et al. | 219/544 |
| 4,571,488 | 2/1986 | Reeves | 219/544 |
| 4,642,154 | 2/1987 | Thalmann et al. | 156/272.2 |
| 4,683,452 | 7/1987 | Henley | 335/234 |

OTHER PUBLICATIONS

*IEEE Standard Dictionary of Electrical and Electronics Terms,* Third Edition, 1984, p. 53.

Petrucci, Ralph H., *General Chemistry Principles and Modern Application,* Third Edition, MacMillan Publishing, NY, 1982, pp. 537–538.

Hudson, Advin and Rex Nelson, *University Physics,* Harcourt Brace Jovanovich, Inc., NY, 1982 p. 666.

*IEEE Standard Dictionary of Electrical and Electronics Term,* Third Edition, 1984, p. 631.

"Magnelatch Option" manufacture's manual pp. 16.6,16.7 of Skinner Valve Options, Skinner Electric Valve Division, New Briton, Conn., U.S.A.

*Primary Examiner*—Leo P. Picard
*Assistant Examiner*—Trinidad Korka
*Attorney, Agent, or Firm*—William C. Fuess

[57] ABSTRACT

An electromagnet defines a gap between a first polepiece in the shape of the butt end of an elongate cylinder and a second polepiece in the shape of a thick annular ring. A permanent magnet having its poles aligned along the axis of the cylinder moves bidirectionally in the gap in response to alternate polarity energization of the electromagnet, serving as a prime mover. When the electromagnet is not energized then the magnetic flux of the permanent magnet shunts an adjacent polepiece, holding the magnet in place. Upon energization of the electromagnet the relatiely strong magnetic flux of the permanent magnet is switched by a relatively weak electromagnetic flux to pass through the electromagnet, exerting an electromotive force on the permanent magnet and causing it to move. This flux switching offers gain: a one-half gram samarium cobalt permanent magnet moves 0.38 mm in response to a 0.015 ampere 1.5 v.d.c. 20 millisecond current pulse ($4.5\times10^{-4}$ joules) and holds at $40\pm2$g's. dislodging acceleration at each of two stable positions where no power is consumed. Back-to-back configurations of the actuator sharing a single electromagnetic coil can be operated single-ended push-pull, double-ended with non-mechanical phase or antiphase lock, and fully independently-controlled multiplexed.

47 Claims, 12 Drawing Sheets

FIG. 2a
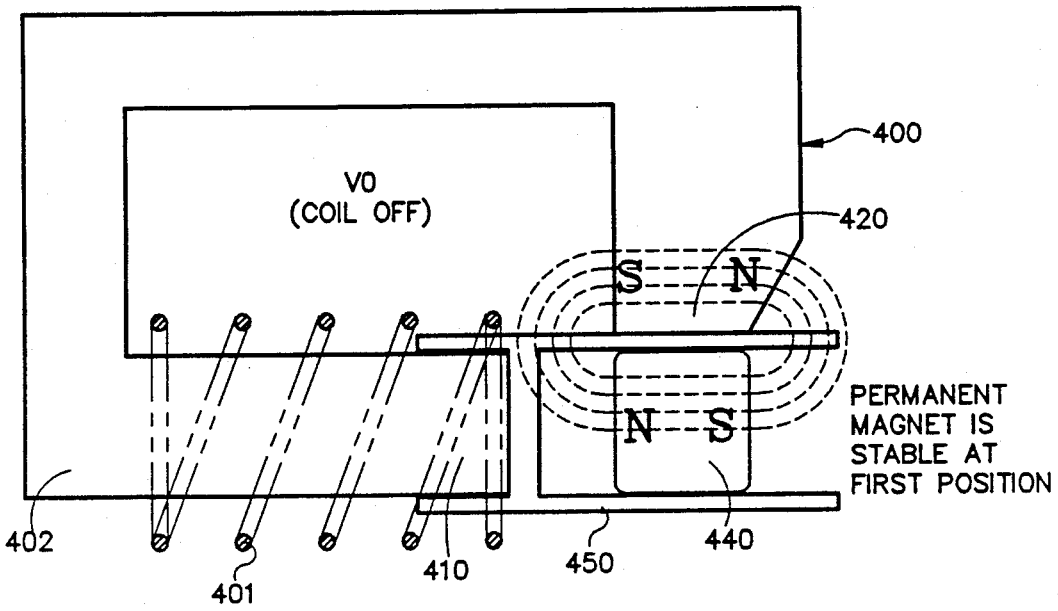
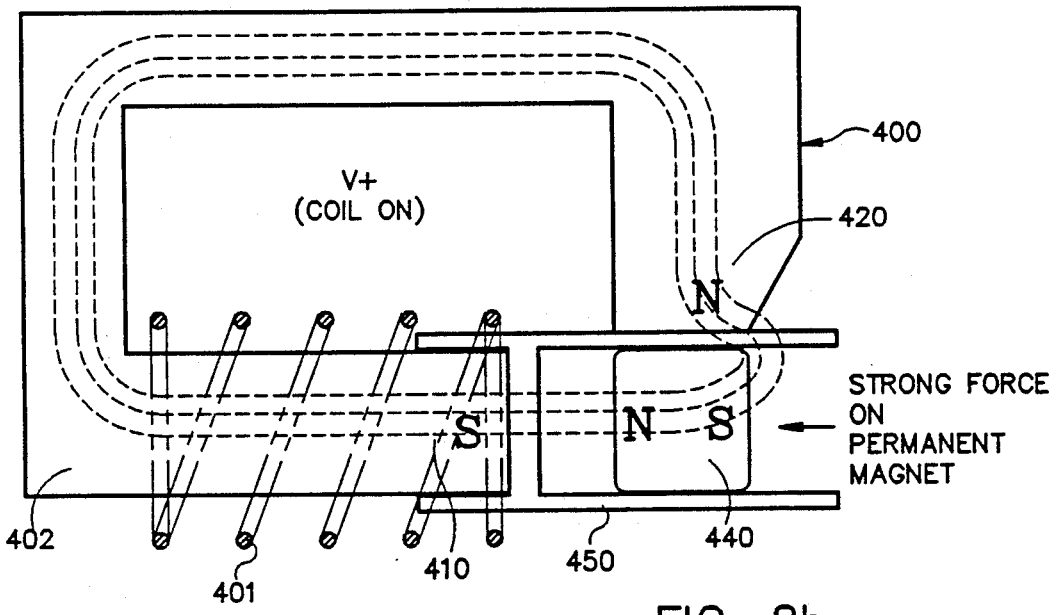
FIG. 2b

FIG. 2c
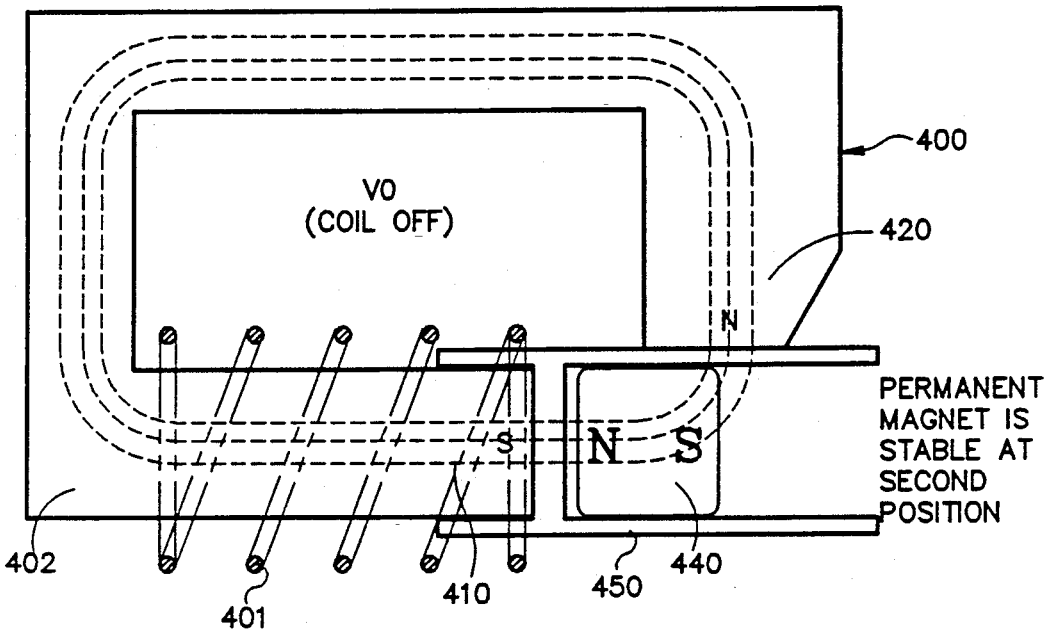
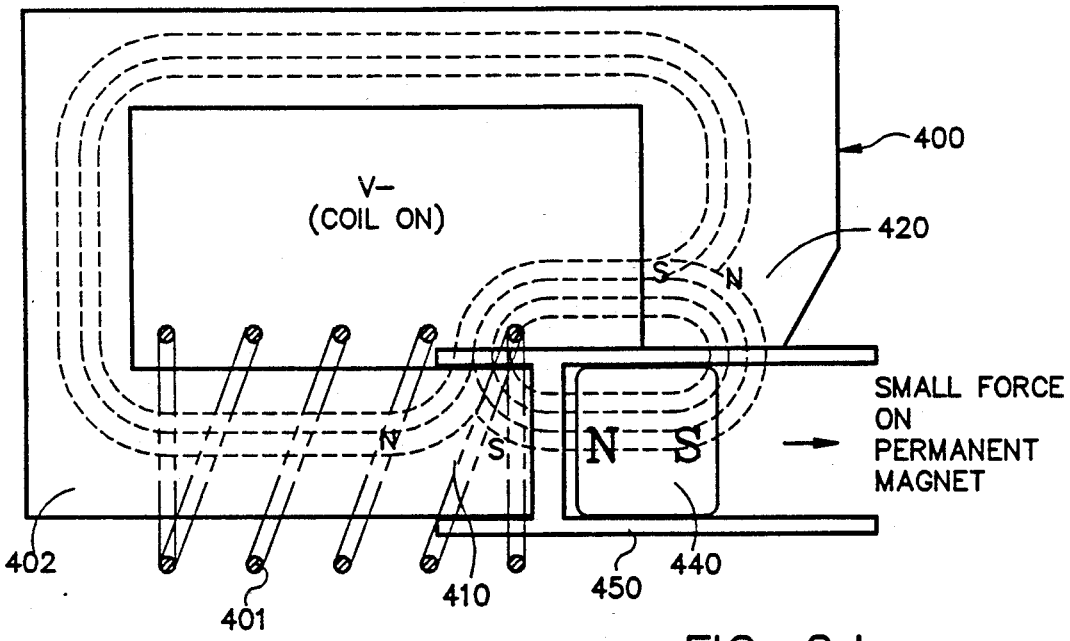
FIG. 2d

HIGH EFFICIENCY, FLUX-PATH-SWITCHING, ELECTROMAGNETIC ACTUATOR

The present patent application is a companion to U.S. patent application Ser. Nos. 07/393,994 and 07/532,171 respectively filed Aug. 15, 1989 and May 25, 1990 for a PRIMARY VALVE ACTUATOR ASSEMBLY.

BACKGROUND OF THE INVENTION

1. Field of the Invention

The present invention concerns electromagnetic actuators producing a linear motion, and more particularly concerns electromagnetic actuators serving as prime movers to produce bi-directional, pushing and pulling, motion and force.

2. Background Art

The electromagnetic actuator in accordance with the present invention will be seen to serve as a prime mover producing, by consumption of electrical energy, linear motion and force between two stable positions where no electrical energy is consumed. The motions undergone, and the forces produced, by the actuator of the present invention are similar to those motions and forces previously derived from solenoids, particularly solenoids of the two-position self-holding type.

A solenoid is intrinsically a device which operates under electrical energization of a coil to pull a solenoid plunger into a position that provides the magnetic field generated by the coil with a magnetic path of minimum reluctance. A pushing movement may be realized from the normal pulling action of a solenoid by use of a lever, or by use of a return spring which is overcome by a solenoid of sufficient force capability. Alternatively, a non-magnetic extension to a solenoid plunger may protrude through a surrounding coil and through the end polepiece and case of the solenoid in the direction of the plunger's movement. When such a non-magnetic plunger extension is present, it interferes with the normal path of magnetic flux, and reduces the efficiency of the solenoid.

Thus the common implementation of a two-position solenoid is simply two back-to-back solenoids. A switch energizes either one solenoid coil, or the other, in order to achieve a pushing, or a pulling, motion. If the two position solenoid is also self-holding, meaning that it need not consume electrical power in order to stably maintain each of its two positions, then it must additionally incorporate some mechanism that holds the solenoid plunger at its alternate positions. Such function can be accomplished by use of mechanical "over-center" devices, such as a Belville disk, or by use of permanent magnets to hold the prime mover in position. Note that in all such latching schemes, wherein the latching device is not inherent in the prime mover, the latching forces realized must always be substantially less than the solenoid force required to overcome the latching mechanism. Thus, the useful output forces of the whole device are less than can be achieved without latching mechanisms.

One preferred embodiment of an electromagnetic actuator in accordance with the present invention will be seen to be micropowered and to achieve a self-holding without any loss of output force. A comparable previous mechanism is the two-position self-holding solenoid part no. SH2L-0224 (NP-15) available from Electro-Mechanisms, Inc., P.O. Box A, Azuza, Calif. 91702. This miniature solenoid, from a manufacturer that specializes in such devices, has a single plunger that moves, responsively to energization of a selected one of two separate coils, in each of two directions. After movement to one end of its path the solenoid plunger is thereafter held in position by a permanent magnet that is affixed to the plunger, and that magnetically contracts the housing of that solenoid coil to which it becomes most closely positioned. Because of this attraction, the solenoid's plunger is held in position even in the absence of any applied holding current.

The electromagnetic actuator in accordance with the present invention will be seen to be highly efficient in the consumption of electrical energy. It is thus illustrative to calculate the energy efficiency of a previous two-position solenoid device, for example the aforementioned SH2L-90224 (NP-15) solenoid device. The moving force of the solenoid plunger has been characterized, together with the strength of the electrical magnetization of the solenoid coil. For a nominal energization of 2.8 volts for a time duration of 5 milliseconds the solenoid plunger of the Electro-Mechanisms, Inc. device will traverse a path of 0.8 mm developing a maximum force of 20 grams. This force will be seen to be roughly equivalent to that force that will be seen to be developed by the preferred embodiment of an electromagnetic actuator in accordance with the present invention. Therefore the energy efficiencies in producing this force in the previous device of Electro-Mechanisms, Inc. (as typical of the solenoid art), and in the device in accordance with the present invention, may be useful compared.

An energy efficiency factor for an electromagnetic actuator may be defined as the work output divided by the energy input. In MKS units, this efficiency will equal Newtons force output times meters of stroke divided by joules (watt seconds) times 100%, and will be expressed in newtons times meters divided by joules (N·M/J) times 100%—a dimensionless quotient.

For the Electro-Mechanisms, Inc. two-position self-holding solenoid type SH2L-0224 the coil resistance is 4.3 ohms. The energy may thusly be calculated as follows:

$$\begin{aligned} E &= \text{power} \cdot \text{time} \\ &= \frac{V^2}{R} \cdot t \\ &= \frac{(2.8\ \text{V})^2}{4.3\Omega} (5 \times 10^{-3}\ \text{sec}) \\ &= 9.12 \times 10^{-3}\ \text{J} \end{aligned}$$

The stroke of the solenoid is 0.8 millimeters. The work may thusly be calculated as follows:

$$W = \int_1^2 F(x) \cdot dx$$

The force F(x) is not constant over the length of solenoid plunger travel between points 1 and 2, but may conservatively be estimated to be less than or equal to 20 grams over the entire distance of travel. Therefore, as a simplication:

$$W = \text{force} \cdot \text{distance}$$
$$= 20\ \text{g} \cdot 9.797 \times 10^{-3} \frac{N}{g} \cdot .8 \times 10^{-3}\ \text{M}$$
$$= 1.57 \times 10^{-4}\ \text{N} \cdot \text{M}$$

The arbitrarily-defined energy efficiency of this particular previous electrical solenoid, as representative of the solenoid art, is calculated as follows:

$$\text{Efficiency} = \frac{\text{Work}}{\text{Energy}} \times 100\%$$
$$= \frac{1.57 \times 10^{-4}}{9.12 \times 10^{-3}} \frac{\text{N} \cdot \text{M}}{\text{J}} \times 100\%$$
$$= 1.72 \times 10^{-2} \frac{\text{N} \cdot \text{M}}{\text{J}} \times 100\% = 1.72\%$$

The energy efficiency of a particular preferred embodiment of an electromagnetic actuator in accordance with the present invention will be seen to be approximately ten times (×10) better than this calculated figure. (The efficiency of this particular preferred embodiment will be seen to be reduced from optimal efficiency because the electromagnetic sections of the actuator will be seen to be isolated by a plastic barrier from fluid water, the flow of which is gated in an exemplary application of the actuator to power a valve. When electromagnetic actuators in accordance with the invention are employed as prime movers in a dry environment their efficiency is anticipated to be roughly two orders of magnitude better than this calculated figure.) Moreover, the actuator in accordance with the present invention will both push and pull by selective electrical energization of a single coil.

The switching of the flux of a permanent magnet by use of an electromagnet is also relevant to the present invention. A previous device that employs flux switching, although not in the manner of the present invention, is the Magnelatch option for the solenoid valves of Skinner Electric Valve Division, New Britain, Conn. The magnelatch option, described as unique in solenoid valve operation, employs a permanent magnet latch circuit for a solenoid valve. Current to maintain the valve in either one of its two positions is not required, as will be seen to also be the case with the actuator in accordance with the present invention. The magnelatch option valve of Skinner Electric Valve includes (1) a saddle, or flux, plate; (2*a*) a main, or latch, coil, (2*b*) a switch coil, (3*a*) a large permanent magnet PM1 used to latch a plunger, (3*b*) a small permanent magnet PM2 the polarity of which can be switched to properly function the valve, (4) pole pieces serving as positioners for magnetic switch PM2, (5) a saddle coupling to encase PM1 and ensure its proper placement in a flux circuit, and (6) a sole, or lower flux, plate.

In operation, a Magnelatch option solenoid valve switches the flux of a small permanent magnet, PM2 by use of a dedicated switch coil. The magnetic flux generated by PM1 may be either in phase with, or out of phase with, a much stronger permanent magnetic flux generated by PM2. The plunger magnetic circuit is surrounded by a gap which is non-magnetic and which provides a high reluctance path. Following the path of least reluctance, the combined flux of PM1 and PM2 will pass along two different circuits dependent upon the current magnetization of switch magnet PM1. In one such circuit, the combined flux of PM1 and PM2 will pass through an outer circuit consisting of PM1, the saddle plate, the PM2 poles, PM2 itself, and the sole plate. In this condition the magnetic circuit has no effect on the plunger, and a spring force and/or fluid pressure is used to hold the plunger on a seat of the valve.

When a momentary pulse of direct current, having correct polarity and duration of approximately 20 milliseconds, is provided to the dedicated coil assembly of switch magnet PM2, it causes PM2 to switch its polarity and to thereafter repel the flux generated by PM1. This action causes the full flux output of PM1 to shunt across the plunger magnetic circuit because this inner circuit now has a lower reluctance than the outer circuit. When the flux travels through the plunger circuit it causes the plunger to move up against a stop and to open an orifice, permitting fluid flow through the valve.

The relevance of the Magnelatch option to the present invention is primarily for showing that the flux of a permanent magnet may be switched, and, if it is so switched, that it can provide forces of useful magnitude in the operation of a solenoid-type device.

In still another area, it is known to use solenoids to actuate hydraulic valves of the diaphragm type. In such valves water from a supply line enters the valve inlet and pressurizes a seat area. This forces a diaphragm away from the seat and the valve opens. A solenoid is selectively actuated to flow the pressurized water through a control conduit to a chamber on the opposite side of the solenoid from the seat area. The area of the diaphragm in the chamber is larger than the valve seat area, producing a net force on the diaphragm toward the valve seat and closing the valve.

Such a hydraulic valve is "normally open", and requires solenoid actuation to close. Hydraulic valves may alternatively be constructed to be "normally closed".

A particular configuration of a diaphragm valve called a 3-way solenoid diaphragm valve is of relevance to one preferred application of an electromagnetic actuator in accordance with the present invention. One such 3-way solenoid diaphragm valve is a Buckner® valve (registered trademark of Buckner, Inc. 4381 N. Brawley Avenue, Fresno, Calif. 93722). Such Buckner® 3-way solenoid diaphragm valve uses a three-way solenoid that controls three orifices to the valve: two orifices to a control chamber and a major orifice through which movement of a diaphragm permits fluid to flow. There is no water path through the center of the diaphragm. Water from a supply line enters the chamber above the diaphragm through an inlet port under solenoid control. Because the area on top of the diaphragm is larger than area below the diaphragm at the valve seat, pressure is greater above diaphragm and the valve closes.

When the solenoid is energized the inlet port is closed and simultaneously a vent port opens at the top of the solenoid. Water from the chamber above the diaphragm is vented to atmosphere through the vent port, lowering the pressure above the diaphragm. Since the pressure is now greater under the diaphragm at the valve seat, valve opens and remains open as long as solenoid is energized and the inlet port is closed.

Notably to the present invention, water flows through the electrical sections of the solenoid in the Buckner® 3-way solenoid diaphragm valve. The necessity of making these sections waterproof increases costs, reduces electrical efficiency due to the increased mechanical separation between magnetic elements in order to accommodate waterproof barriers, and hazards failure if water shorts the electrical circuit. A preferred application of an electromagnetic actuator in accordance with the present invention will be seen to perform the selective occluding of two orifices to a control chamber of a 3-way diaphragm valve totally without contact between the gated water and the electrical sections of the actuator, or without significant hazard that such contact will occur.

SUMMARY OF THE INVENTION

The present invention contemplates switching the path of the relatively strong magnetic flux of a permanent magnet with a relatively weak electromagnetic flux. The flux-path-switching is used to implement an electrically-activated electromagnetic actuator, or prime mover, that is at least ten times more efficient than the best previous devices. Moreover, the actuator is bidirectional push-pull in operation—unlike a conventional solenoid that is pull only. Moreover, the moving element of the actuator holds strongly at each of two stable positions without any consumption of power.

For example, one preferred embodiment of the invention is micropowered. A one-half gram moveable plunger member including a samarium cobalt permanent magnet moves approximately 0.38 mm (0.015 inches) in either of two directions between two stable positions in response to a 0.015 amperes, 1.5 v.d.c., 20 milliseconds duration current pulse ($4.5\times10^{-4}$) watt-seconds, or joules) of appropriate polarity. No power is consumed at either stable position. Retention, or holding, forces developed at each of the two stable positions are approximately $20\pm1$ grams. Accordingly, resistance to inadvertent actuation of the mechanism by shock is high, approximately $40\pm2$ g's dislodging acceleration.

The actuator in accordance with the present invention has an electromagnet and a permanent magnet. The electromagnet has two polepieces separated by a gap. The first polepiece is typically formed as the butt end of an elongate cylinder. This first polepiece connects in a low magnetic permeability path, typically made of iron, to a second polepiece. An electrical coil is wound around the path, typically in the region of the elongate cylinder. The second polepiece is typically in the shape of a thick annular ring. It is oriented orthogonally and symmetrically to the longitudinal axis of the elongate cylinder, and is spaced apart from the cylinder's butt end. The electromagnet is essentially configured as a pot electromagnet having a second, outer, polepiece that is extended radially inwards towards a first, core, polepiece until there is only a relatively small, by the standards of conventional solenoids and pot electromagnets, gap between the polepiece.

A permanent magnet is constrained to move in the gap between the first and the second polepiece of the electromagnet. Its movement in the gap is coaxial with the longitudinal axis of the elongate cylinder first polepiece, and perpendicular to the plane of the thick annular ring second polepiece. The constraint for this movement may be provided by the polepieces themselves, predominantly the annular ring second polepiece. The constraint is normally provided, however, by a nonmagnetic thin-walled cylindrical tube, or sleeve, that is located concentrically along the longitudinal axis between the butt end of the first polepiece and the annulus of the second polepiece, and which has an external diameter than substantially equals the internal diameter of the annulus. (As well as its constraint function, the cylindrical tube serves to physically isolate the electromagnet, and all electrical sections of the actuator, from the permanent magnet. When the moving permanent magnet is used, in an exemplary application of the actuator, to power a valve to gate the flow of fluid water, then the cylindrical tube will physically isolate all electrical sections of the actuator from the fluid water. This isolation is highly desirable.) The permanent magnet is normally in the shape of a cylinder that is complementary in diameter to the bore of the tube, and that is about as long as the thick annular ring of the electromagnet's second polepiece is wide.

The permanent magnet has its magnetic poles aligned along the longitudinal axis. It moves in the tube, and in the gap, from a first position proximate to and substantially within the annulus of the annular ring second polepiece to a second position proximate to the butt end of the elongate cylinder first polepiece in response to a first-direction energizing current in the electromagnet, and in response to the electromagnetic flux associated with such first-direction current. In this direction of the permanent magnet's movement, it "pulls". The permanent magnet moves oppositely in response to an opposite, second-direction, energizing current. In this opposite direction of the permanent magnet's movement, it "pushes".

The permanent magnet will maintain its first position proximate the second polepiece, or its second position proximate the first polepiece, without any energizing current in the electromagnet whatsoever. In each of these two stable positions the magnetic flux of the permanent magnet is substantially shunted through the then-proximate polepiece, causing the permanent magnet to attract the polepiece and to hold its position thereat.

It is theorized with high confidence that when the actuator's electromagnet is energized by a current of either polarity, then the resultant electromagnetic biasing flux causes the magnetic flux of the permanent magnet, which flux is typically much larger than the biasing electromagnetic flux, to switch from shunting through an adjacent polepiece to instead pass through the low magnetic permeability path, including both polepieces, of the electromagnet. It is theorized that the flux of the permanent magnet switches path and "lines up" and sums with the flux of the electromagnet. It is theorized that the flux of the permanent magnet changes from "shunt flux" to "through flux".

Regardless of the theoretical basis of the actuator's operation, the permanent magnet moves, under the electromotive force of the combined flux, to the opposite polepiece. When the energization of the electromagnet ceases, the flux of the permanent magnet again becomes a "shunt flux", shunting the adjacent polepiece and holding the permanent magnet in position thereat.

The permanent magnet not only moves extremely efficiently (under force of the only energy input to the system, the electromagnetic flux generated by the electromagnet), but holds strongly without energy input of each of its two stable positions. The actuator in accordance with the invention is accordingly bidirectional push-pull, and is "latching" or "holding" in each of two stable positions.

Thus the actuator, as described to this point, is extremely simple having only electromagnet and permanent magnet components. It is, of course, the geometries and magnetic properties and orientations of the components that permits the actuator to act to switch the path of a relatively strong magnetic flux of a permanent magnet with the relatively weak electromagnetic flux of an electromagnet. The preferred embodiment of an actuator in accordance with the present invention is, however, more complex.

One reason that a more sophisticated embodiment of the actuator is preferred is in order to better balance the holding power at each of the two stable positions. Another reason that a more sophisticated embodiment of the actuator is preferred is in order to increase the length of travel of the prime mover. The theoretical analysis of certain enhancements to the rudimentary embodiment of the actuator in order to obtain a preferred embodiment is fairly complex, and is left for the Detailed Description of the Invention section of this specification disclosure.

However, the enhancements themselves (if not the analysis of their effects) are straightforward. The enhancements are basically (i) a spring, that is (ii) constrained to operate against the movement of the permanent magnet only over a limited range by dint of forcing against (iii) a hollow moving plunger (the new prime mover element) that contains the moving permanent magnet within an internal cavity.

In detail, the preferred embodiment of the actuator contains a spring that acts (indirectly) between the electromagnet and the moving permanent magnet in a direction that tends to force the permanent magnet from its second to its first stable position. The force of the spring is exerted relatively more strongly against the permanent magnet as it draws closer to the electromagnet's first polepiece, and is exerted relatively more weakly against the permanent magnet at an increasing distance of separation from the first polepiece.

The spring force is constrained so as not to act (even indirectly) upon the permanent magnet over its entire course of travel, and to instead operate upon the permanent magnet only at and near its second stable position. This constraint to the range of operation of the spring could be provided by an expedient as simple as placing stops to the action of the spring. However, in accordance with the present invention the constraint is preferably realized by causing the spring to act against a hollow plunger that contains the moving permanent magnet within its cavity.

The permanent magnet moves, at different times, against both of two opposite walls to the plunger's cavity, larger than the permanent magnet, within which the permanent is contained and constrained. In its second stable position the permanent magnet is hard against a wall of the plunger's cavity, and the plunger is in turn hard against a spring that is storing maximum energy (normally in compression). However, in its second stable position the permanent magnet is not against either wall of the plunger's cavity within which it is contained. The plunger (only) continues to be subject to the spring force. The plunger becomes the prime mover element, and the moving permanent magnet serves to move the plunger with a mechanical assist from the spring.

There are many characterizations, variously based on energies and forces and times of flight and still other criteria, by which the complex electromagnetic and electromechanical action of the preferred embodiment of an electromagnetic actuator in accordance with the present invention may be explained. One useful theory of the operation of the preferred embodiment of the electromagnetic actuator holds that the relatively strong magnetic field of a permanent magnet is switched by a relatively smaller electromagnetic field. When the magnetic field of the permanent magnet is switched then it induces electromotive force on the permanent magnet, causing it to move.

However, the moving permanent magnet does not develop equal force everywheres in its path. Accordingly, in certain regions of the path where a strong electromotive force is developed this force is gainfully employed to move a prime mover element, or plunger, against the force of a spring. The spring becomes compressed, and remains compressed while the prime mover element, or plunger, is held in a second stable position under a high force developed by the permanent magnet.

When the electromagnetic field is reversed, therein permitting and urging the permanent magnet to move in the return path, then the spring force both (i) helps to get the permanent magnet moving in the reverse direction and (ii) provides a residual force that is usefully used to hold the prime mover element, or plunger, against a stop with high retention force.

No energy is gained by the preferred use of spring, nor by making the spring force operative only over a portion of the path of the permanent magnet—the electromagnetic actuator does no more work than the electrical energy that it receives. However, the preferred embodiment of an actuator device in accordance with the present invention provides usefully high retention forces (e.g., able to resist dislodging accelerations of $40\pm2$ g's) in each of two stable positions that are separated by a useful distance (e.g , 0.38 mm). The device is thus useful to position some physical element, such as the occluding element of a valve, that must (i) controllably assume different spatial positions at different times, and (ii) reliably maintain these positions without power once assumed. In accordance with the present invention, this electrically controllable repositioning is accomplished extremely efficiently (e.g., with $4.50\times10^{-4}$ joules of energy).

In one particularly efficacious configuration two electromagnetic actuators in accordance with the present invention sharing a single electromagnetic coil are arrayed back-to-back. An astounding flexibility of operation is permitted. Each individual actuator is intrinsically a "push-pull", position holding, prime mover device. A double-ended configuration of two back-to-back actuators sharing a common electromagnet coil is inherently non-mechanically phase-locked in its motion. If the magnetic poles of the permanent magnets of each back-to-back actuator are symmetric about the centerline of the double-ended combined actuators (i.e., the magnetic poles of the two permanent magnets are aligned oppositely) then both permanent magnets will move in the same direction upon each energization of the common electromagnetic coil. Conversely, if the magnetic polarity of one of the permanent magnets is reversed then the two permanent magnets will move in opposite directions, either both outwards or both inwards at each energization of the common electromagnetic coil.

Finally, the double-ended back-to-back combined actuators are capable of independently controlled multiplexed operation. This operational mode arises because an actuator can intentionally be made to require more energy, and/or energy for a longer time, to move in one direction than to move in the other direction (i.e., to "push" rather than "pull", or to "pull" rather than "push"). When two actuators so constructed are arrayed back-to-back with a common electromagnetic coil then selective magnitudes, or durations, of energization of the coil will selectively cause the movement of one actuator but not the other. Four states for the two actuators are obtainable: both "pulled in", or both "pushed out", or either actuator "pulled in" while the companion actuator is "pushed out". The flexibility in moving and retaining forces producible by actuators in accordance with the present invention is accordingly very great, while this degree of control is achieved using only a two-wire connection to the single coil.

These and other aspects and attributes in accordance with the present invention will be come increasingly clear upon reference to the following specification and accompanying drawings.

BRIEF DESCRIPTION OF THE DRAWINGS

FIG. 2, consisting of FIG. 2*a* through FIG. 2*d*, diagrammatically shows the operational principles of an actuator in accordance with the present invention.

DETAILED DESCRIPTION OF THE INVENTION

Figure 1:
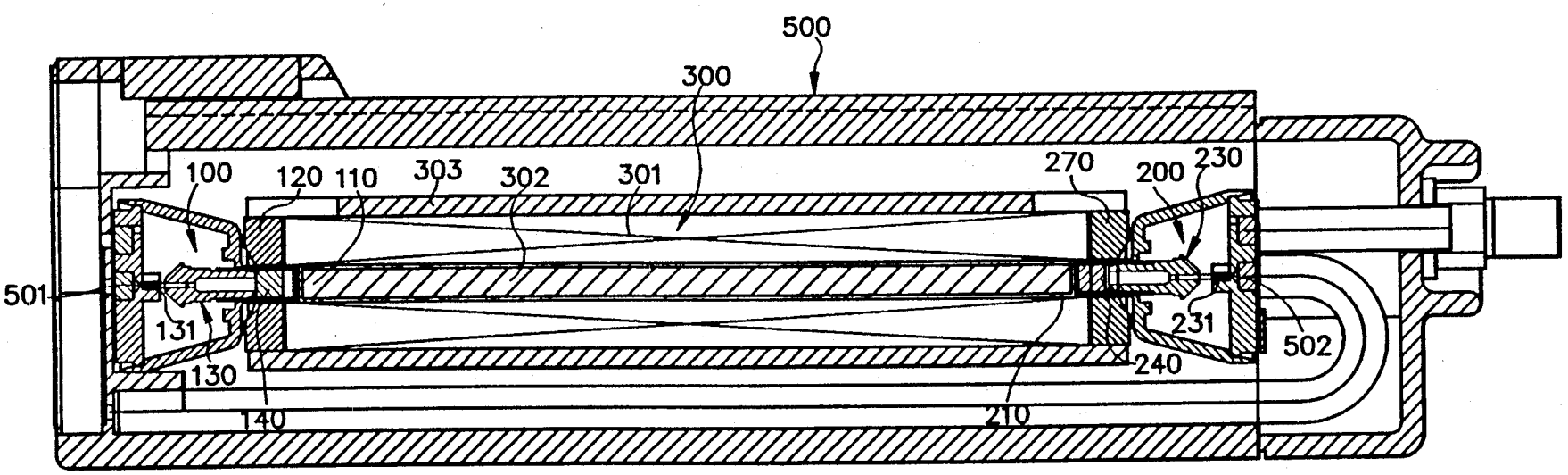
FIG. 1 is a cross-sectional plan view of two back-to-back actuators in accordance with the present invention in operational use within a valve assembly for gating the flow of fluid.

Electromagnetic actuators in accordance with the present invention serve as prime movers. They may, for example, serve to selectively move the plunger of a valve between positions upon, and separated from, a valve seat located within a channel flowing fluid, forming thereby an electromagnetic valve. One such application of two electromagnetic actuators 100, 200 in accordance with the present invention is shown in FIG. 1.

The back-to-back electromagnetic actuators 100, 200 share a common electromagnet 300. In the electromagnet 300 a coil 301, typically 7,000 turns of 31 gauge copper wire (diameter 0.0101–0.0105", nominally 10.2 mils), surrounds a core 302, typically made of iron. The cylindrical iron core 302 has butt ends 110, 210 which respectively serve as the first pole pieces to actuators 100, 200.

The second polepieces 120, 220 to the actuators 100, 200 are in the shape of thick annular rings. These rings are oriented orthogonally and symmetrically to the longitudinal axis of core 302, and are spaced apart from its butt ends 110, 210. The entire electromagnet 300 is contained within a case 303, which is waterproof in the illustrated application. The actuators 100, 200 and their common electromagnet 300 exhibit substantial circular and radial symmetry about a central longitudinal axis of core 302.

The two electromagnetic actuators 100, 200 need not be controlled with one electromagnet 300. Electromagnet 300 will suffice to control either electromagnetic actuator 100 or electromagnetic actuator 200 only. Conversely, each of the actuators 100, 200 could have its own electromagnet. However, the electromagnetic actuators 100, 200 shown in FIG. 1 may operate in tandem responsively to the direct current energization of the single coil 301 of the single electromagnet 300.

In particular, the permanent magnet 140 and the plunger 130 of electromagnetic actuator 100 will be positioned as illustrated, holding the ball tip 131 of plunger 130 against a first valve seat 501 of housing 500, simultaneously that permanent magnet 240 and plunger 230 of electromagnetic actuator 200 are also positioned as illustrated, holding the ball tip 231 of plunger 230 away from valve seat 502 of housing 500. A fluid flow channel exists through valve seats 501, 502 of housing 500, as is more particularly explained in companion U.S. patent application Ser. No. 07/393,994 for a PRIMARY VALVE ACTUATOR ASSEMBLY filed on Aug. 15, 1989 and assigned to the same Assignee as the present application. The contents of that application are incorporated herein by reference.

For the purposes of the present invention, it need only be understood that (i) the permanent magnets 140, 240, and their associated plungers 130, 230, are the moving elements of respective electromagnetic actuators 100, 200, and (ii) these elements may be, preferably, caused to move left and right in tandem. In order to so move left and right in tandem the magnetic polarities of permanent magnets 140, 240 are in an opposite sense, left to right.

Interestingly, the magnetic polarity of one of the permanent magnets 140, 240 may be left-to-right reversed, making the magnetic polarities of both permanent magnets 140, 240 to be in the same sense, left-to-right. In such a case the permanent magnet 140, and its associated plunger 130 will move left (right) while the permanent magnet 240, and its associated plunger 230, moves right (left).

Interestingly, the actuators 100, 200 need not be so controlled to move either together, or oppositely, in tandem. Rather, the coil 301 of electromagnet 300 may be energized to a voltage that will cause only a selected one of the electromagnetic actuators 100, 200, to move. The actuators 100, 200, are thusly capable of moving independently sequentially, as will be explained in more detail later after the operation of the actuators 100, 200 is explained.

The detailed structure, and operation, of the preferred embodiment electromagnetic actuators 100, 200 will be further discussed in conjunction with FIG. 3. However, before considering the preferred embodiment of the actuators, it is useful to consider a simplified representation of the actuator showing the bidirectional movement undergone by its permanent magnet. This representation is contained within FIG. 2, which also shows lines of magnetic flux, and magnetic poles, that are theorized to occur during operation of an actuator in accordance with the present invention. Because the magnetic flux lines nor the magnetic poles can neither be visualized—as can the movement of the permanent magnet—nor readily measured—as are those forces of the actuator which are plotted in FIG. 4—it must be understood that the proposed flux-switching theory of the actuator's operation is hypothetical and tentative only, and that the scope of the present invention is not to be limited by the accuracy or completeness of such theory, nor by the pictorial representations of the theory in the form of the magnetic flux lines and poles appearing within FIG. 2.

FIG. 2 shows the basic operation of an actuator in accordance with the present invention. Forebearing understanding of this operation, it is difficult to understand why the basic permanent magnet and electromagnet components of the actuator in accordance with the present invention are shaped, proportioned and located as they are, let alone to understand the esoteric function of a plunger, used within the preferred embodiment of the actuator, that contains the permanent magnet and constrains its travel and a spring which acts over only a portion of the plunger's (and its contained electromagnet's) travel.

The basic operation of the present invention is diagrammatically illustrated in FIG. 2, consisting of FIG. 2*a* through FIG. 2*d*. Coils of wire 401, corresponding to the coil 301 shown in FIG. 1, wrap a magnetically permeable core 402, corresponding to core 302 shown in FIG. 1—forming thereby an electromagnet 400 corresponding to electromagnet 300 shown in FIG. 1. The electromagnet 400 has a first polepiece 410 and a second polepiece 420. These polepieces, by their particular orientation in FIG. 2, may be respectively compared to first polepiece 210 and second polepiece 220 of electromagnetic actuator 200 shown in FIG. 1. A permanent magnet 440 (which may be compared with permanent magnet 240 of electromagnetic actuator 200 shown in FIG. 1) is constrained by cylindrical tube, or sleeve, 450 to move along the longitudinal axis of electromagnet 400 between positions more, and less, proximate to its polepieces 410, 420.

The electromagnet 400 in particular may be recognized to be simplified relative to the electromagnet 300 shown in FIG. 1 for not exhibiting, among other things, a substantial circular and radial symmetry about a longitudinal axis of its first polepiece 410. The structure, and showing, of FIG. 2 is intentionally rudimentary so that the operation, and the theoretically hypothesized operational principles, of an actuator in accordance with the present invention may be clearly observed. The electromagnet 400, the permanent magnet 440, and the tube 450 may each exhibit both circular and radial symmetry about a longitudinal axis of first polepiece 410, and do so exhibit both symmetries in the preferred embodiment of the invention.

A first stable position of permanent magnet 440 relative to the electromagnet 400, and to the polepieces 410, 420 thereof, is shown in FIG. 2*a*. In this stable position no voltage is applied across, and no electrical energization is applied to, coil 401. Correspondingly, the only appreciable flux within the electromagnet 400, which is made of a material which exhibits no appreciable permanent or residual flux, is theorized to be induced. This flux is induced by the N and S poles of permanent magnet 440, as indicated. These north N and south S poles of permanent magnet 440 are aligned along a longitudinal axis substantially identical to the longitudinal axis of electromagnet 400 at the position of its first polepiece 410. The longitudinal axis of permanent magnet 440 and electromagnet 400 are both substantially coaxial with an axis along which electromagnet 440 is constrained to move, and does move (as will be shown). The N and S poles of the permanent magnet 440 are theorized to induce both an s and n pole in second polepiece 420.

In FIG. 2 a capital letter "N" or "S" indicates a magnetic pole that is theorized to be relatively strong while a letter "n" or "s" indicates a magnetic pole that is theorized to be relatively weak. It will be recognized by a designer of magnetic circuits that there are no absolutes in the locations or strengths of magnetic poles, and that the theoretical representations of such within FIG. 2 are for purposes of guidance only, and are not limiting of the actual operation of actuators in accordance with the invention.

The position of permanent magnet 440 proximate the second polepiece 420 of electromagnet 400, which position is shown in FIG. 2*a*, is called its first stable position. In this position the magnetic flux of permanent magnet 440 is hypothesized to be substantially shunted through second polepiece 420 of electromagnet 400. This causes the permanent magnet 440 to attract the second polepiece 420, and to hold its illustrated position. This will be the case even when there is no voltage, Vo=zero volts, across the coil 401 of electromagnet 400.

The hypothesized realignment of magnetic flux occurring when the coil 401 of electromagnet 400 is energized by a first, V+, voltage is diagrammatically illustrated in FIG. 2*b*. The N and S poles of permanent magnet 420 are hypothesized to still be aligned as they were in FIG. 2*a*. However, the energization of electromagnet 400 is hypothesized to cause its first polepiece 410 and second polepiece 420 to respectively assume a S and a N polarity. The N pole of permanent magnet 440 is strongly attracted to the (now) S first polepiece 410 of electromagnet 400. The shunt flux of permanent magnet 440 is hypothesized to be converted to a thru-flux through the core 402 of electromagnet 400. The permanent magnet 440 thus moves to the position shown in FIG. 2*c*.

A second stable position of permanent magnet 440 is illustrated in FIG. 2*c*. The electromagnet 400 is not energized, and there is no voltage (i.e., Vo) in coil 401. The permanent magnet 440 is proximate to the second polepiece 410 of electromagnet 400. The N and S poles of permanent magnet 440 are hypothesized to respectively induce a s pole in second polepiece 410, and a n pole in first polepiece 420, of permanent magnet 400. The magnetic flux from the permanent magnet 440 is hypothesized to thread both polepieces 410, 420 and the core 402 of electromagnet 400 in attempting to find a path of minimum magnetic reluctance. The permanent magnet 440 is held to both polepieces but may be considered to be most strongly attracted to second polepiece 410 because it is proximate to only a portion of the first polepiece 420. The magnetic flux of permanent magnet 440 is now substantially a thru-flux.

The hypothesized switching of the magnetic flux, and the corresponding forces exerted on permanent magnet 440, when the coil 401 of electromagnet 400 is energized with a voltage V− of opposite polarity to that voltage V+ previously illustrated in FIG. 2*b* is illustrated in FIG. 2*d*. The coil 401 is energized with a negative voltage, V−. This voltage V− is hypothesized to tend to induce a north pole at first polepiece 410 and a south pole at second polepiece 420. However, the electrically induced n pole at first polepiece 410 is hypothetically countered by the s pole induced by permanent magnet 420 in the same first polepiece 410. Meanwhile, an electrically induced south pole in first polepiece 420 is hypothesized to cause a positional shifting of the n pole in such polepiece 420 from its FIG. 2*c* location, and a s pole is hypothesized to result from appear at first polepiece 420 as indicated due to a combination of the electromagnetic field and magnetic induction from permanent magnet 440. The shunt flux of permanent magnet 440 is hypothesized to again be substantially a thru-flux through the core 402 of electromagnet 400.

The illustrated alignments of the hypothesized poles causes a rightwards force on permanent magnet 440. This force is relatively smaller than the force which was exerted on the permanent magnet 440 during the opposite energization of the coil 401 that was illustrated in FIG. 2*b*. Nonetheless, the permanent magnet 440 will move to the right, reassuming its initial starting position shown in FIG. 2*a*.

The force exerted by permanent magnet 440 in moving from its first to its second stable position illustrated in the sequence from FIG. 2*b* to FIG. 2*c* is not equivalent to the force exerted by the same permanent magnet 440 in moving from its second to its first stable position as illustrated in the sequence from FIG. 2*d* to FIG. 2*a*. This statement is not hypothetical—the force can be measured. Neither is the retention force exerted by the permanent magnet 440 in its first stable position illustrated in FIG. 2*a* the same as the retention force exerted by permanent magnet 440 in its second stable position illustrated in FIG. 2*c*. Again, these retention forces can be measured. The permanent magnet 440 is hypothesized, however, to have its shunt magnetic flux switched as indicated in FIGS. 2*a*–2*d* by the varying energization of electromagnet 400. The hypothesized switching of this shunt flux is believed to be the reason permanent magnet 440 moves between two stable positions, and also why it tends to remain at each such stable position, even though the electromagnet 400 is not energized, once the position is assumed.

The permanent magnet moves forcibly in each of two direction when the path of its flux is switched, and acts as a prime mover.

The flux switching of the actuator converts (i) a shunt flux that exists between the permanent magnet and whichever one of the two polepieces it is then proximate upon such times as the electromagnet is unpowered to (ii) a thru-flux passing through both the permanent magnet and the entire iron core of the electromagnet upon such times as the electromagnet is powered. The switching of the flux in each of two opposite senses induces an electromotive force on the permanent magnet in each of two opposite directions, making the actuator in accordance with the present invention inherently a "push-pull" device as opposed to a solenoid that is "pull" only.

Moreover, the permanent magnet has a high residual magnetic field. When this field shunts a proximate one of the two polepieces it holds the permanent magnet in position without application of energy. The actuator in accordance with the present invention is inherently "self-latching" or "self-holding" in each of its time stable positions, and requires neither any energy input nor any additional components to hold position.

The electromagnetic actuator in accordance with the present invention thus for described forcibly moves in each of two directions, and holds an assumed position. It is thus an obviously useful prime mover device.

The holding power of the permanent magnet, expressed in grams force or g's, is not equivalent at each of its two stable positions. During various conditions of operation of the actuator the force on the permanent magnet may be in a direction either towards or away from the first polepiece. The direction of the force, and its magnitude, depend both on (i) the energization condition of the electromagnet, and (ii) the varying distance of separation of the permanent magnet from the first polepiece. The force is different for the three electromagnet energization conditions of (i) an electromagnet current in the first direction, (ii) no current in the electromagnet, or (iii) an electromagnetic current in the second direction.

The force on the permanent magnet versus its distance of separation from the first polepiece for each of the three conditions may be plotted as three curves. Each curve slopes upwards at a decreasing distance of separation between the permanent magnet and the first polepiece. These curves show that the second stable position where the permanent magnet is proximate the butt end of the elongate cylinder produces strong retention forces. However, the first stable position where the permanent magnet is within the annulus of the second polepiece does not produce retention forces that are equally as strong.

Moreover, the length of travel of the permanent magnet (as opposed to a plunger member of which it will soon be seen to be a part within the preferred embodiment) between the two positions is undesirably short, on the order of only 0.25 mm (0.01") in rudimentary embodiments of the actuator. (In the preferred embodiment of the actuator the permanent magnet will travel about 0.38 mm (0.015") between two stable positions.)

The force with which the permanent magnet holds each of its two stable positions, and the distance of separation between these positions, are both important to ensuring reliable operation of the actuator in the presence of mechanical and electrical tolerances of construction, and environmental shock and vibration. An actuator having a permanent magnet that holds position with greater force at alternative stable positions that are spatially relatively closer together can countenance equal tolerances of construction and shock during use to an actuator having a permanent magnet that holds position with lesser force at alternative stable positions that are spatially relatively further apart.

Therefore enhancements to the basic, rudimentary, embodiments of the invention are desired in order to simultaneously improve its operational characteristics by improving both the (i) retention forces and (ii) distance of travel of the permanent magnet.

As a first step toward enhancing the rudimentary embodiment of the actuator a spring is added between the electromagnet and the permanent magnet. The spring exerts a force in a direction that assists the permanent magnet in moving from its second to its first stable position. This spring, which is not mandatory for operation, changes and extends the operating region of the actuator device. The spring force provided by the spring may be accounted for as a simple addition to the three curves depicting the force on the permanent magnet occurring with each of the three energization conditions. The addition of a spring force usefully permits a relatively lower net retention force to be developed at the second stable position, and a relatively higher net retention force at the first stable position.

A relatively stronger spring force is exerted against the permanent magnet as it draws closer to the electromagnet's first polepiece; a relatively weaker spring force is exerted against the permanent magnet at increasing distance of separation from the first polepiece. Powerful magnetic forces are present in the region proximate the electromagnet's first polepiece both during energization of the electromagnetic coil with the first-direction current, and also during the absence of coil energization while the permanent magnet is at its second stable position. These powerful magnetic forces have no difficulty overcoming the relatively stronger spring force at this region. When the second-direction current is applied to the electromagnet then the spring aids the permanent magnet to begin to transit from its second to its first stable position. The spring force extends the operational region of the actuator, and does not merely relocate it.

Without more, the spring and its spring force do not constitute a complete panacea to the operation of the actuator. Both the rudimentary springless, and the enhanced spring-loaded, actuators require very tight electrical and mechanical tolerances for reliable operation, and develop only modest retention forces at stable positions that are very close together. Although either the rudimentary embodiments of springless or the spring-loaded actuators in accordance with the present invention are suitable for some applications, the actuator is preferably still further improved specifically in order to (i) increase the distance separation between the two stable positions, and (ii) increase the retention forces exerted at each such position.

In accordance with the present invention, the desired increases are realized by an additional stratagem. This stratagem is simply explained, but produces complex effects.

The stratagem is to constrain the spring force so as not to act upon the permanent magnet over its entire course of travel, and at both its stable positions. Instead the spring force is caused to act only at and near the permanent magnet's second stable position.

In constraining the operation of the spring force, the permanent magnet itself becomes divorced from being the prime mover. This prime mover function becomes abrogated to another element called a plunger. The permanent magnet moves within a longitudinal cavity of the plunger between its two stable positions. In the course of its movement it contacts the end walls of the plunger's cavity, inducing movement in the plunger. At its second stable position the permanent magnet is hard against the end wall of the plunger's cavity, and hard against the spring force. However, at its first stable position the magnet becomes located at a position within the plunger's cavity that is spaced apart from either of the end walls of the cavity. At this first stable position the permanent magnet is located substantially within the annulus of the second polepiece, just as it has always been. The length of the permanent magnet's travel is extended beyond the length of travel of the plunger, again extending the operational region of the actuator.

The plunger is, however, pushed onwards and away from the first polepiece by the spring, ultimately coming to rest at a stop, or detent. At this position the plunger itself, serving as prime mover, exhibits considerable gram force. The plunger thus moves, under force of (i) the permanent magnet moving responsively to the electromagnetic field, and (ii) the spring, between two stable positions. At each of these positions the plunger exhibits a usefully strong force.

A more detailed view of the structure, and the operation, of an electromagnetic actuator in accordance with the present invention—by example electromagnetic actuator 100 previously seen in FIG. 1—is shown in FIG. 3, consisting of FIG. 3*a* through FIG. 3*d*. The electromagnetic coil 301 causes, when selectively energized in each of two selective polarities, a corresponding electromagnetic field to be induced between first polepiece 120 and second polepiece 110. The second polepiece 110 is the butt end of the cylindrical core 302 to the electromagnet 300 (both seen in FIG. 1). It connects in a path of low magnetic permeability, typically made of iron, to the second polepiece 120. The second polepiece 120 is in the shape of a thick annular ring. It is oriented orthogonally and symmetrically to the longitudinal axis of the first polepiece 110, and is spaced apart from the first polepiece 110.

A permanent magnet 140 is constrained to move along the longitudinal axis of second polepiece 110 within a cavity of a cap, or can, 131 to plunger 130 that fits within a guide, or sleeve, 540. The magnetic axis of the permanent magnet 140 is aligned along the longitudinal axis along which the permanent magnet 140 is constrained to move, and along which the permanent magnet 140 does move (as illustrated in FIG. 2).

The relative proportions, and spacing, of the electromagnet's polepieces 110, 120 relative to permanent magnet 140 deserve consideration. The permanent magnet 140 is preferably in the shape of a cylinder. Its diameter is preferably approximately equal to the diameter of the first polepiece 110, which is also typically cylindrical. The thickness of the cylinder of permanent magnet 120 is preferably approximately equal to the thickness of the annular ring of the first polepiece 120 at the regions of such first polepiece 120 proximate to its annular opening. The first polepiece 120 is typically and preferably beveled, as illustrated at location 121, at its annulus, and only on that side opposite to first polepiece 110, in order to concentrate the magnetic flux that it channels into the region of its annulus where permanent magnet 140 is variously positioned.

The spacing between the butt end of the second polepiece 110 and the annulus of the first polepiece 120 is typically and preferably not so wide as the cylinder of permanent magnet 140 is thick, but is typically and preferably a substantial portion of the thickness of the cylinder of permanent magnet 140. This spaced apart separation between second polepiece 110 and first polepiece 120 relative to the thickness of permanent magnet 140 particularly permits that hypothetical flux coupling that is illustrated in FIG. 2*c*.

Figure 3B:
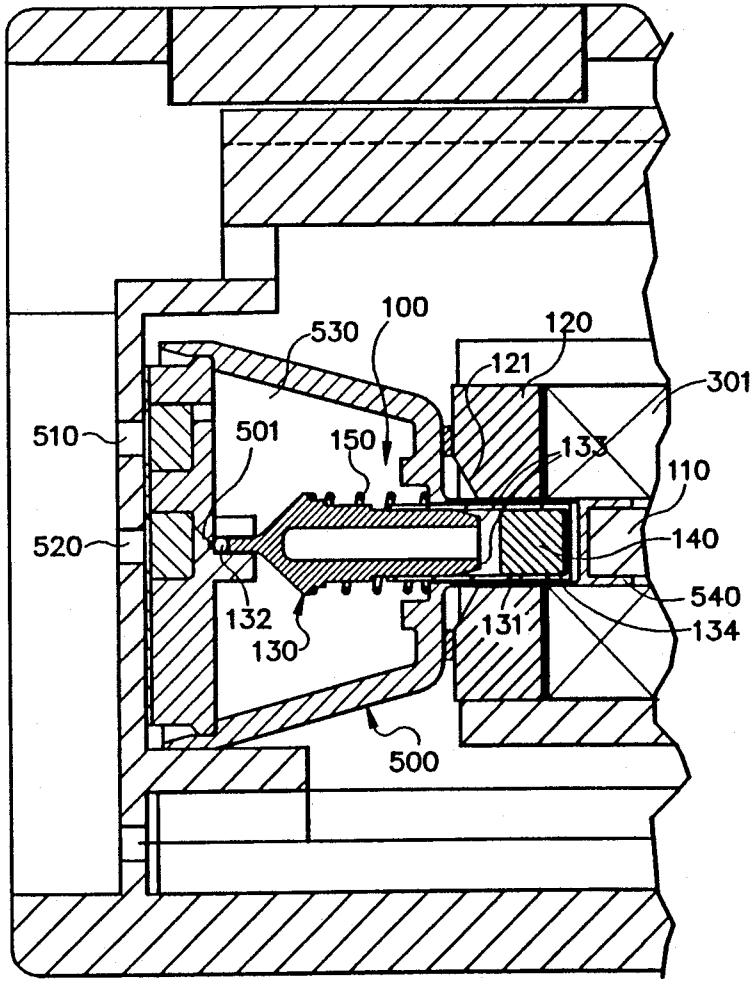
FIG. 3, consisting of FIG. 3*a* through FIG. 3*d*, shows positions assumed by the left-most actuator assembly previously shown in FIG. 1 during various times of its operation.
Figure 3A:
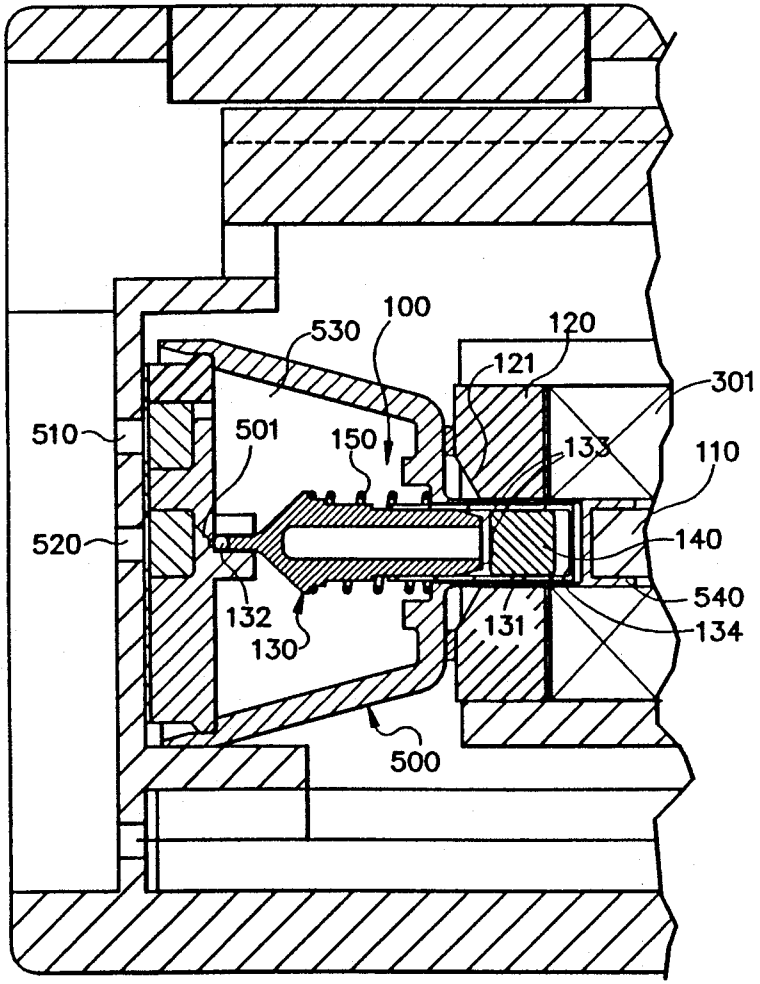
Figure 3D:
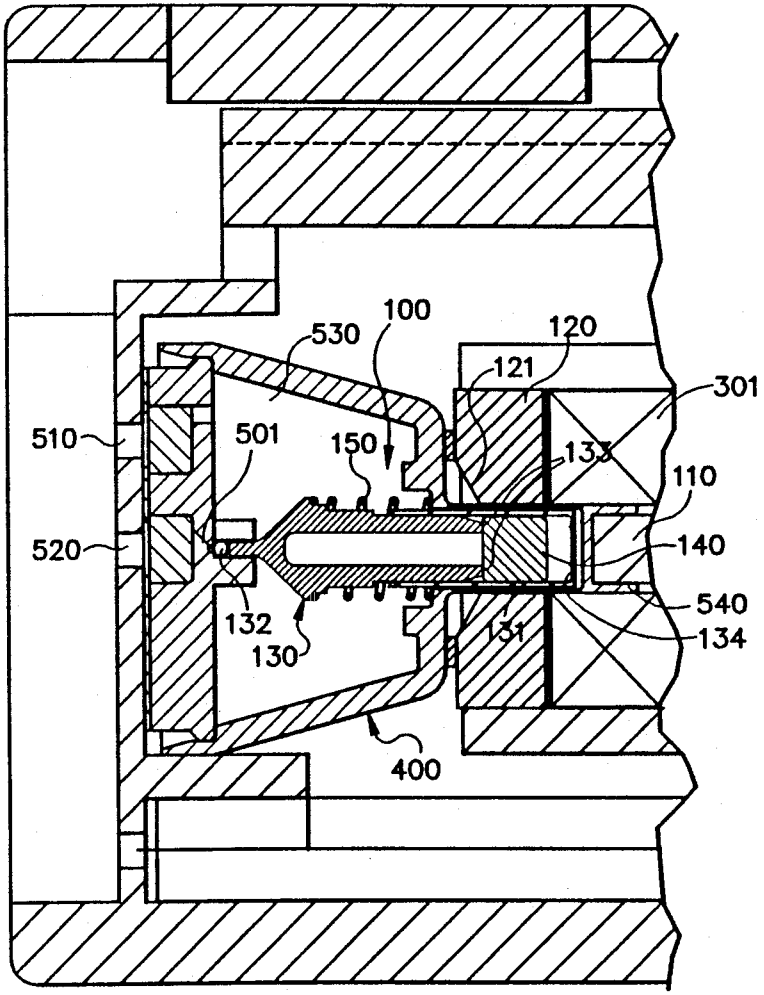
Figure 3C:
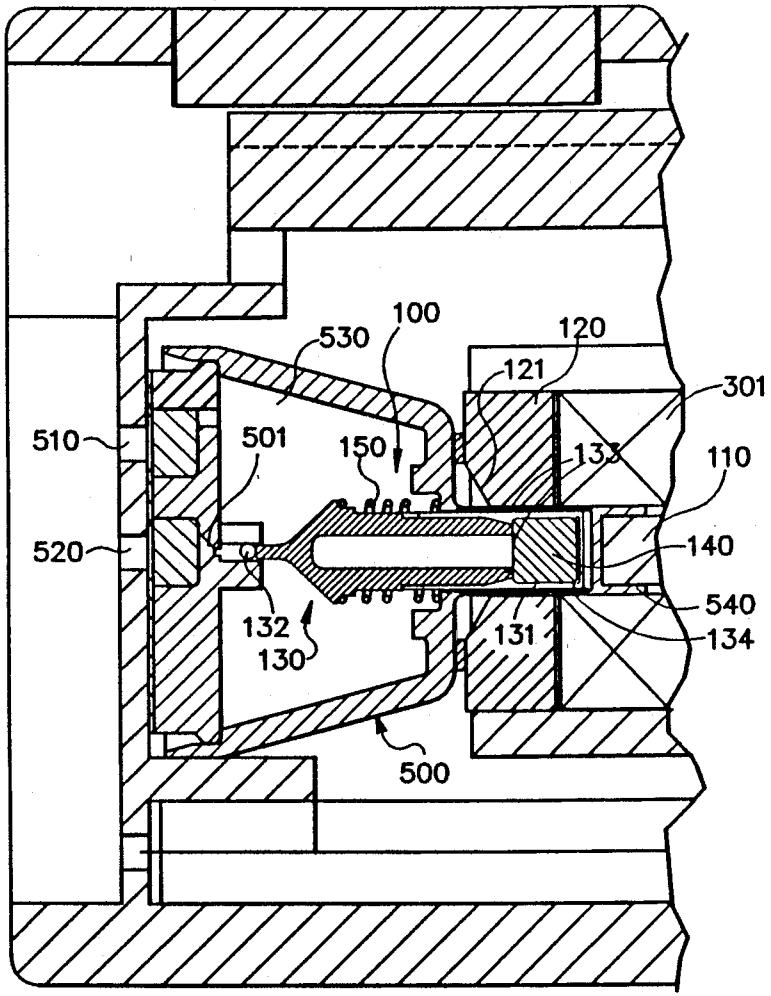

Continuing with the mechanical description, the tip end of plunger 130 is in the shape of a small spheroid, or ball, 132. The spheroid 132 is rigidly affixed to the plunger 130, and moves therewith to variously be seated against (as illustrated in FIG. 3*a*, 3*b*, and 3*d*) the valve seat 501, or away from such valve seat 501 (as illustrated in FIG. 3*c*). The plunger 130 is biased in its movement relative to housing 500 by spring 150 which is operative between plunger 130 and housing 500 so as to tend to force spheroid 132 against valve seat 501.

During use of the actuator 100 to control the flow of fluid, pressurized fluid in channel 520 must pass through the orifice of valve seat 501 into cavity 30 before exiting the cavity at channel 510. Force is required to keep the spheroid 130 seated on the valve seat 501 against the pressure of the fluid in channel 20, which is typically at many pounds per square inch.

This force is provided, in that first stable state of the actuator 100 that is illustrated in FIG. 3*a*, by spring 150. The operation of the actuator 100 must be so that plunger 130, and spheroid tip 132 thereof, may be drawn away from the valve seat 401 (rightwards in FIG. 3) to open the valve and permit the flow of fluid. The actuator 100 has a second stable position, illustrated in FIG. 3*c*, whereat the valve is open. No energization of electromagnet coil 301 is required to hold the actuator 100 in this its second stable position. Energization of coil 301 occurs only to move the permanent magnet 140 and plunger 130 of electromagnetic actuator 100 between the two stable positions.

Figure 4A:
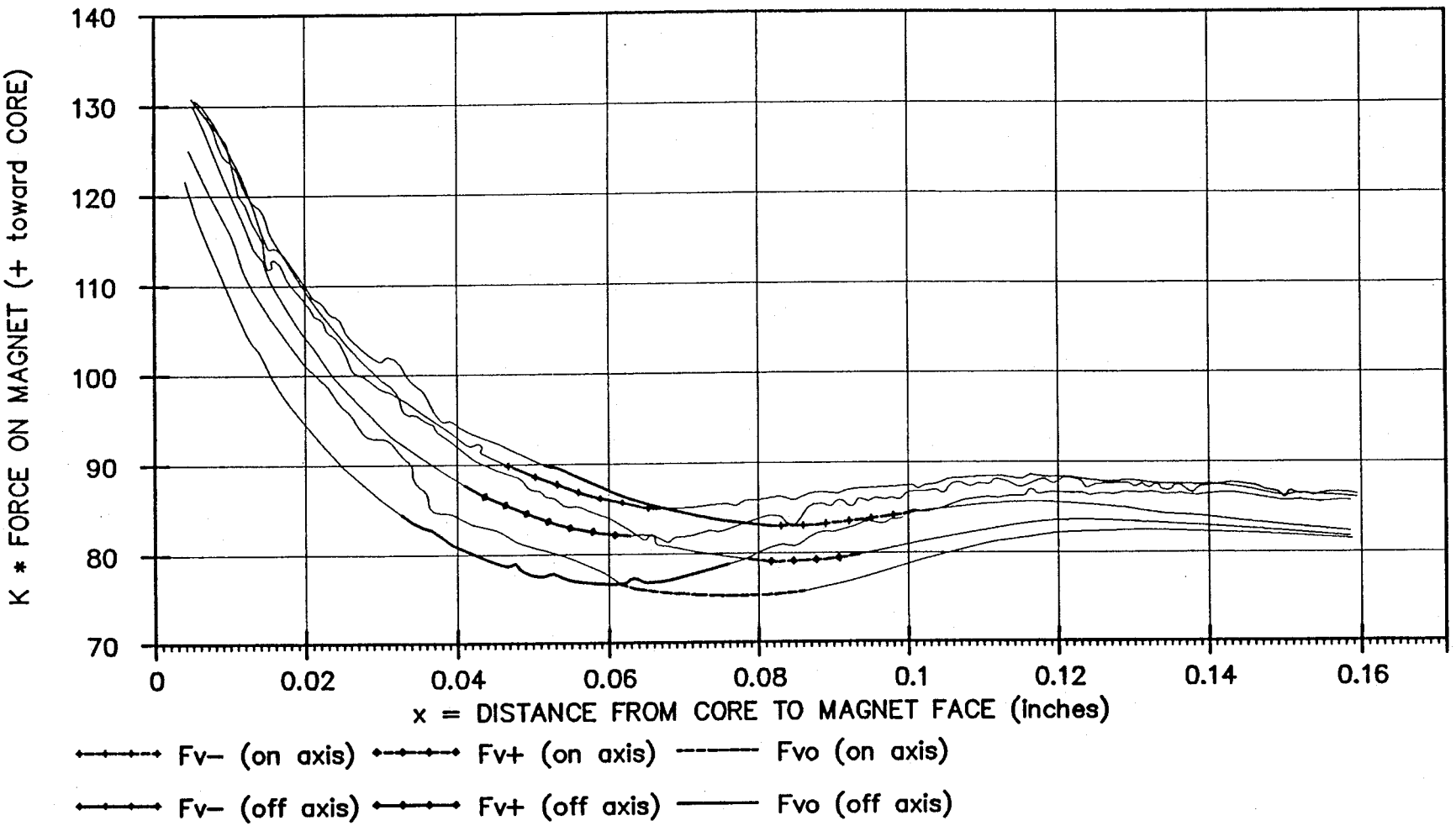
FIG. 4*a* is a graph showing forces exerted on the permanent magnet of an actuator in accordance with the present invention at varying distances of separation from a first pole piece of the electromagnet, and at varying on- and off-axis orientations relative to the axis of the electromagnet.
Figure 4B:
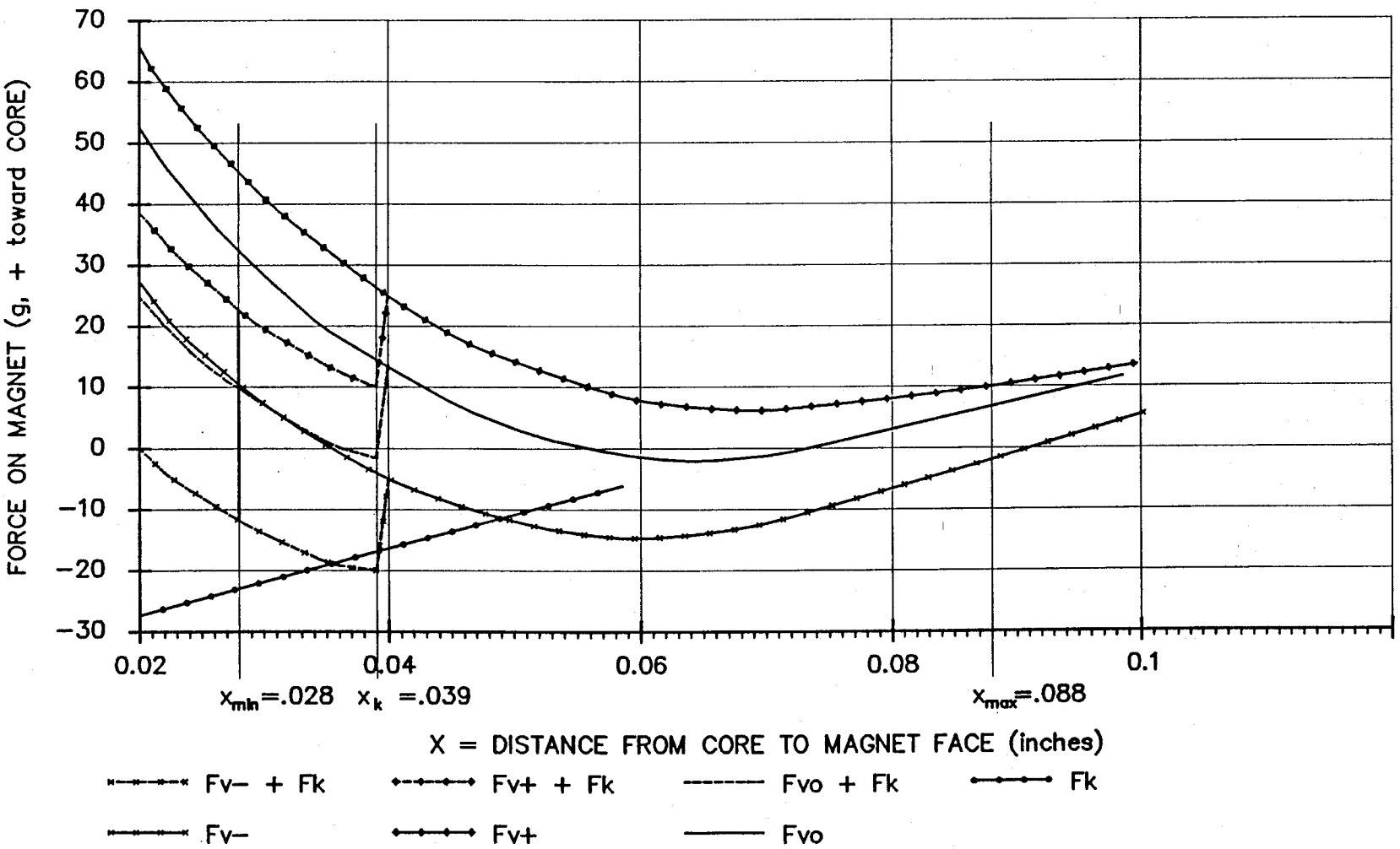
FIG. 4*b* is a graph showing the forces exerted on the permanent magnet at various distances of separation from the first pole piece of the electromagnet during various energization conditions of the electromagnet, and both with and without an accompanying spring biasing force.
Figure 4C:
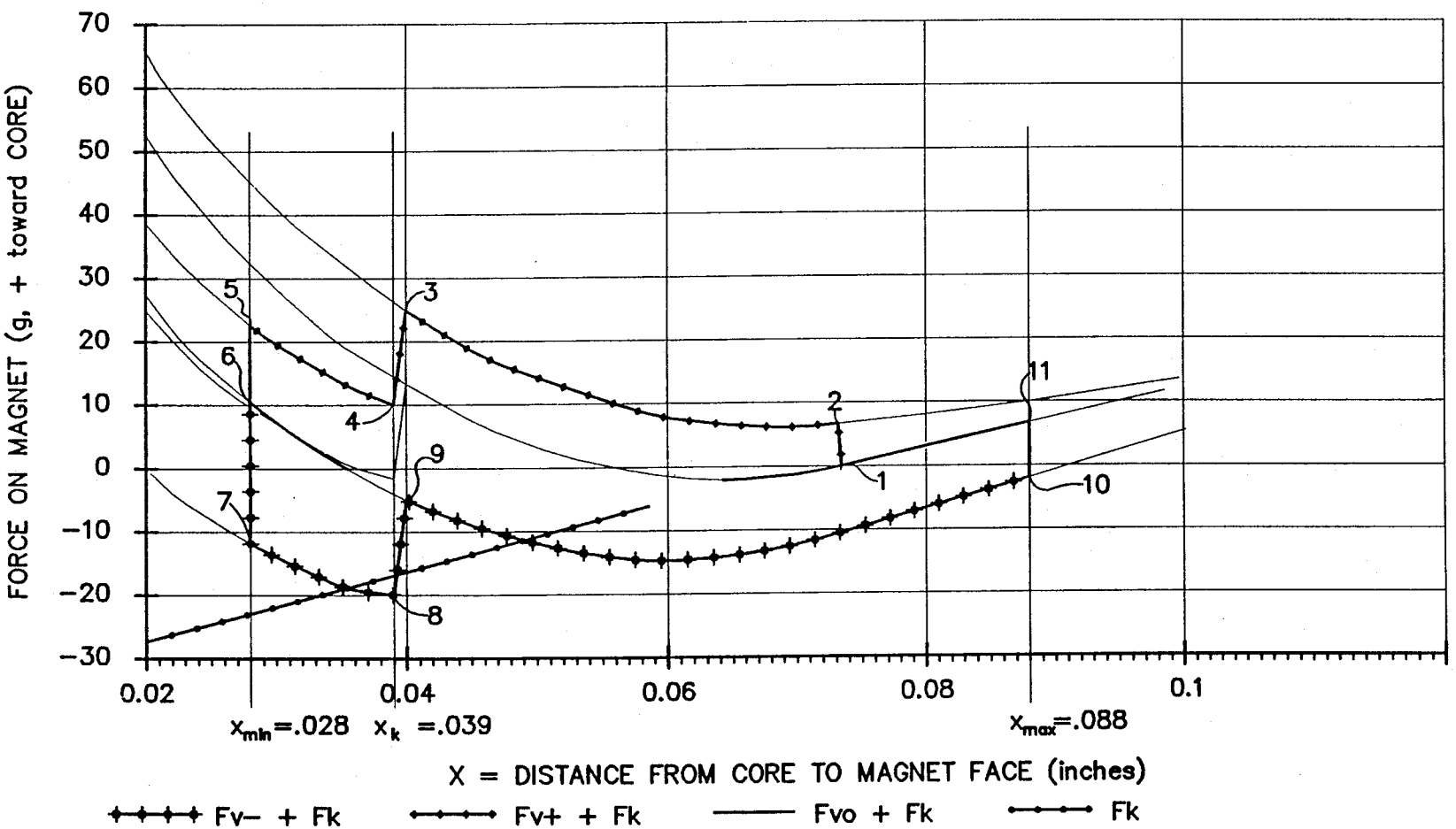
FIG. 4*c* is a graph, similar to FIG. 4*b*, upon which the operational state diagram of the actuator in accordance with the present invention is traced.

The manner of how this is accomplished for a preferred embodiment actuator 100 in accordance with the present invention is illustrated in the sequence of FIGS. 3*a* through 3*d*, and is graphed in FIG. 4, particularly at FIG. 4*c*.

FIG. 3*a* corresponds to FIG. 2*a* but is, of course, in the opposite left to right orientation. In FIG. 3*a* the permanent magnet 140 is located at its second stable position within the annulus of the electromagnet's first polepiece 120. Note that at this stable position the permanent magnet 140 is located approximately intermediary within the cavity of cap, or can, 131 to plunger 130. At this position it is separated from the surfaces 133, 134 of the cavity to plunger 130.

FIG. 3*b* illustrates a situation intermediary between the situations of FIG. 2*b* and FIG. 2*c*. The electromagnet coil 301 has been energized by voltage of a first polarity, causing the electromagnet 140 to commence to move toward second polepiece 110. At the situation shown in FIG. 3*b*, the electromagnet 140 has moved so far so as to contact the surface 134 of the cavity of the plunger 130, but not so far so as to assume its final position as closely proximate to polepiece 110 as it will be allowed to come (that position being illustrated in FIG. 3*c*). At the position of permanent magnet 140 shown in FIG. 3*b* it must, in order to continue further toward second polepiece 110, move the plunger 130 against the force of spring 150. As will shortly be graphically illustrated in FIG. 4, the motion of permanent magnet 140 toward polepiece 110 produces strong forces that will be sufficient to move plunger 130 against the force of spring 150.

FIG. 3*c* corresponds to FIG. 2*c*. The permanent magnet 140 has drawn as close to second polepiece 110 as the continued thicknesses of the cap, or can, 131 of plunger 130 and the cylindrical tube, or sleeve, 540 permit. The permanent magnet 140 will hold this position without electrical energization of electromagnet coil 301. The spring 150 will be held compressed, and the spheroid 132 at the tip of plunger 130 will be held at a separation from valve seat 501.

A fluid flow path is opened between fluid inlet channel 520 and fluid outlet channel 510. Notably, the fluid that is within cavity 130 will not, due to a tight fit between the cap 131 of plunger 130 and housing 500, be within the cavity of plunger 130, or in any contact with the electromagnet 300 and its polepieces 110, 120. Plunger 130 may thus be used as the prime mover element of electromagnetic actuator 100 in isolation from the electrical sections of such actuator 100. This can be useful in order to prevent corrosion of the electrical sections, possible ignition of explosive gases or fluids, and/or the necessity to use specialty materials within the electrical sections due to the contact of the electrical system with gases or fluids gated by action of the plunger 130.

FIG. 3*d* shows a transient situation occurring in the operation of the preferred embodiment of actuator 200. In FIG. 2 this situation would correspond to an overshoot of the permanent magnet 140 in its transition from its first stable position shown in FIG. 2*d* to its second stable position shown in FIG. 2*a*. Such an overshoot may or may not occur, depending upon the strength of the electromagnetic forces and the inertial masses involved, in the rudimentary embodiment of the actuator diagrammed in FIG. 2. Within the preferred embodiment of the actuator 100 diagrammed in FIG. 3, the condition shown in FIG. 3*d*—a transient overshoot position of magnet 140—is, by visual observation through a transparent sleeve, or tube, 540 to housing 500 and through a transparent cap 131 to plunger 130, believed to occur. It is, however, not necessary that the particular condition illustrated in FIG. 3*d* should occur in order that the actuator 100 should operate correctly.

The condition illustrated in FIG. 3*d* shows the permanent magnet 140 when it has been repulsed from the second polepiece 110 and has been attracted to the first polepiece 120 by an energization, opposite in polarity to the energization illustrated in FIG. 3*b*, of electromagnet coil 301. The movement of permanent magnet 140 has been initially assisted by surface 134 of plunger 130 under force of spring 150. The plunger 130 has moved only so far, however, as is permitted by contact of its spheroid 134 against valve seat 501. The permanent magnet 140 may continue in motion to actually, under force of momentum, overshoot its second stable position within the annulus of the electromagnet's first polepiece 120. It may bang into surface 133 of plunger 130, thereby further helping to seat spheroid 132 tightly against valve seat 501. Ultimately, however, the permanent magnet 140 will assume, possibly with a slight oscillation, its second stable position within the cavity of plunger 130 as was previously illustrated in FIG. 3*a*.

The motions diagrammed in FIG. 2*a*—which motions might be undergone by a rudimentary electromagnetic actuator in accordance with the present invention—and the similar motions diagrammed in FIG. 3 that are undergone by the preferred embodiment electromagnetic actuator 100 in accordance with the present invention, are straightforward. It is, however, difficult to understand clearly why the actuators do what they do, and why the preferred embodiment of the actuator 100 is constructed as it is, unless the forces operating upon such actuator are analyzed. The forces operating on the electromagnetic actuator in accordance with the present invention are so analyzed in FIG. 4, consisting of FIG. 4*a* through FIG. 4*f*.

A graph of the relative magnetic force, in arbitrary units, exerted on the permanent magnet 140 in a direction toward second polepiece 110 versus its distance of separation from such polepiece 110 is plotted for six different conditions in FIG. 4*a*. The six different conditions represent a permanent magnet 140 that is moving directly along the longitudinal axis of the second polepiece 110, or which is slightly misaligned from such longitudinal axis, for each of the three conditions of (i) coil energization with a first voltage, v−, (ii) coil energization with an opposite second voltage, v+, or (iii) no coil energization, voltage equals vo.

All curves shown in FIG. 4*a* rise to the left, showing that at a short distance of separation the permanent magnet 140 experiences an attractive force toward the second polepiece 110 regardless of the polarity of energization, or the non-energization, of electromagnet 300. At an intermediary distance of separation the permanent magnet 140 undergoes a minimum in the force of its attraction toward the second polepiece 110. At still higher distances of separation, when the permanent magnet is being pulled out of the annulus of first polepiece 120 (in a direction opposite to second polepiece 110), its attraction toward the second polepiece 110, and toward the main body of the first polepiece 120, again increases slightly.

The set of two curves shown in FIG. 4*a* representing a first, v−, energization of the electromagnet coil 301 are higher in some regions, and lower in other regions, than the set of two curves representing the second, v+, energization of electromagnet coil 301, which curves are themselves again higher in some regions, and lower in other regions, than the set of two curves representing no energization of electromagnet coil 301. The crossovers between the various curves, which define the operation of the preferred embodiment of actuator 100, will be the subject of FIGS. 4*b* through 4*f*.

Generally, the showing of FIG. 4*a* is simply that the actuator 100 in accordance with the present invention can be expected to exhibit curves upon each condition of energization that are in an equivalent relationship to curves that exhibited upon other conditions of energization regardless of the on or off-axis tolerances in the movement of permanent magnet 140. The teaching of FIG. 4*a* is generally of (i) the forces experienced by the permanent magnet 140, and is specifically of (ii) one condition of mechanical tolerance, the on or off-axis movement of permanent magnet 140, that can reasonably be tolerated within the actuator 100 in accordance with the present invention.

Figure 4D:
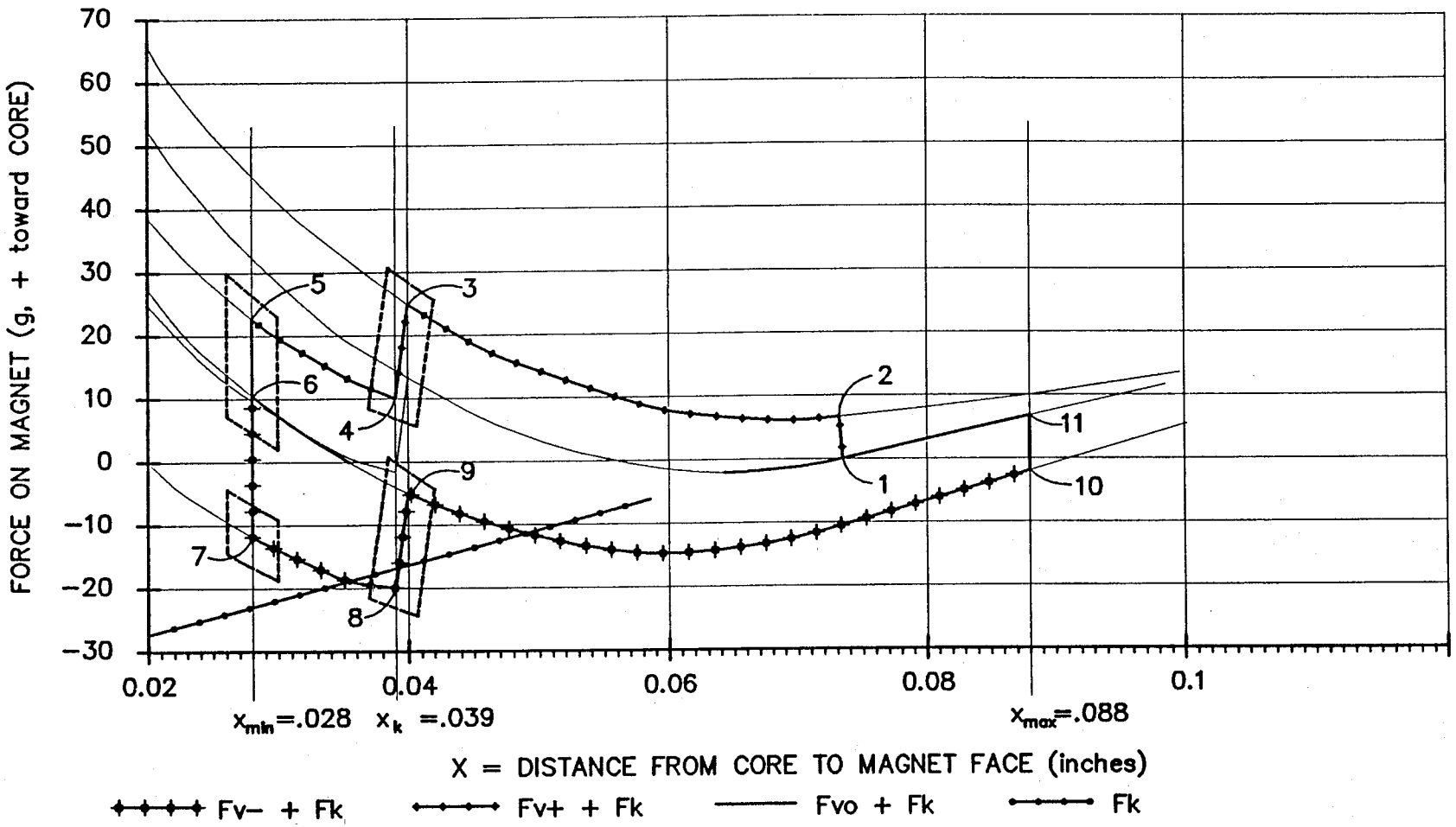
FIG. 4*d* is a graph, similar to FIG. 4*c*, showing the effect of mechanical and electrical tolerances on the operational state diagram of an actuator in accordance with the present invention.

The forces on actuator 100 graphed in FIGS. 4*a* through 4*c* are real, and representative of actuators that can readily and repetitively be constructed. Further mechanical and electrical tolerances contributing to the performance of actuator 100 will be shown in FIG. 4*d*. FIGS. 4*a* and 4*d* jointly show that actuators in accordance with the present invention can be constructed over a reasonably range of mechanical and electrical tolerances, and will function reliably over a range of such tolerances encountered during real-world operation.

A plot of the force on the permanent magnet 140 in a direction toward the electromagnet's second polepiece 110 for varying distances of separation from such polepiece 110 is shown in FIG. 4*b*. The horizontal scale of the distance from second polepiece 110 of the electromagnet core 302 to the nearest face of the permanent magnet 140 is marked with a minimum distance, $X_{min}$, typically approximately 0.028" and a maximum distance $X_{max}$, typically approximately 0.88". In its preferred embodiment the actuator 100 is micropowered. The distances shown represent the nominal minimum and maximum distances by which permanent magnet 140 that is typically ½ gram weight samarian cobalt may be separated from the second polepiece 110 in this particular embodiment. The plotted spring force begins to resist the movement of the permanent magnet 140 toward the second polepiece 110 at a predetermined distance of separation from the second polepiece 110. In the particular actuator 100 plotted in FIG. 4*b*, this distance is nominally 0.039". The actual, quantitative, spring force at this separation distance is normally ±20 grams. The non-linear spring force increases in a direction forcing permanent magnet 140 away from second polepiece, until it is 250% higher at a separation distance of $X_{min}$.

The topmost curve shown in FIG. 4*b*, which curve is continuous if the spring force is not added, is the force Fv+ experienced by the permanent magnet 140 when the electromagnet coil 301 is energized with a positive first voltage, v+. The middle continuous curve is the force Fvo exerted on the same permanent magnet 140 when the electromagnet coil 301 is not energized, or is subject to zero voltage vo. Finally, the bottom continuous curve represents the force Fv− on permanent magnet 140 when the electromagnet coil 301 is energized with a second, negative, voltage v−.

The middle curve of FIG. 4*b* showing the force on the permanent magnet with no energization dips from positive force (towards second polepiece 110) to negative force (away from second polepiece 110 and towards first polepiece 120) with increasing distance of separation between the permanent magnet 140 and the second polepiece 110. The Fv− curve for negative, v−, energization of electromagnet coil 301 shows that the force on permanent magnet 140 is generally negative, and away from first polepiece 110. However, note that the force on the permanent magnet 140 is towards the first polepiece 110 if it is very close to such polepiece 110 (i.e., at a separation distance close to $X_{min}$) even if the electromagnet is energized with voltage v−. This is because the magnetic field of permanent magnet 140 is typically much greater in strength than the magnetic field of the electromagnet.

In accordance with the present invention, a spring force is added, preferably over a limited spatial range, to the magnetic forces experienced by permanent magnet 140 during all conditions of energization of the electromagnet. The force Fk of a preferred spring is plotted in FIG. 4*b* as a straight line. The spring is chosen to exhibit roughly the inverse shape of the curves, Fv−, Fv+, and Fvo in the region between $X_{min}$ and $X_k$.

In accordance with the design of the preferred embodiment of the actuator 100 shown in FIGS. 1 and 3, this non-linear spring force operates on the movement of permanent magnet 140 only over a limited range between $X_{min}$ and $X_k$. The spring force is additive to the magnetic forces experienced by permanent magnet 140 over this operational range. The combination of spring and magnetic forces experienced by the permanent magnet 140 is variously graphed as force curves Fv++Fk; Fvo+Fk; and Fv−+Fk, all within that range between $X_{min}$ and $X_k$ over which the spring force operates, in FIG. 4*b*. The non-linear spring force is additive to the magnetic forces to displace, and to change the slope of, the three curves representing magnetic force (only) over that distance range $X_{min}$ to $X_k$ within which the spring force is operative. The region at which the spring force, nominally occurring at a separation between the electromagnet's first polepiece 110 and the opposed face of the permanent magnet 140 of approximately 0.039", is not shown to be infinitesimally narrow (i.e., the line coupling the non-linear spring force is not vertical at this point). The spring force is either coupled, or uncoupled, near some distance of separation $X_k$. The narrow band range of $X_k$=0.039" (nominal) to approximately 0.04" is meant to show that the actuator may exhibit some mechanical tolerance regarding the precise dimension at which the spring force becomes applied to the movement of permanent magnet 140, and also that the entire spring force is not instantaneously coupled and uncoupled.

An operational state diagram of a preferred embodiment of an electromagnetic actuator 100 in accordance with the present invention is shown in FIG. 4*c*. When the permanent magnet 140 is at its first stable position, as illustrated in FIG. 3*b*, it resides at point 1 on the Fvo force-distance curve. At this point, wherein the permanent magnet 140 is separated from the first polepiece 110 by approximately 0.75", there is no force on such permanent magnet either towards, or away from, such first polepiece 110.

When a first voltage Fv+ is applied to the electromagnet then the force of the permanent magnet jumps to point 2, and becomes positive towards the first polepiece 110. The permanent magnet 140 will travel toward first polepiece 110 until, at distance $X_k$ equals approximately 0.039", it hits the surface 134 of can 131 of plunger 130, and commences to engage non-linear spring 150. Over the distance between points 3 and 4 the permanent magnet 140 will fully engage spring 150, and will thereafter proceed along the curve Fv++Fk to point 5. At this point 5 both the permanent magnet 140 and the plunger 130 are fully retracted against the electromagnet's first polepiece 110, and are at a minimum distance of separation $X_{min}$ equals approximately 0.028". Note that forces on the permanent magnet 140 during its entire course of travel between points 2 and 5 responsively to the first, Fv+, energization of the electromagnet has uniformly been positive, or towards the electromagnet's first polepiece 110.

At some time after the permanent magnet 140 has reached point 5, the Fv+ energization of the electromagnet will be cut off, and the force on the permanent magnet at separation $X_{min}$ from first polepiece 110 drops to point 6 on the curve Fvo+Fk. Note that the force on the permanent magnet 140 at point 6, its second stable position, is still positive. The permanent magnet 140 is attracted to the electromagnet's first polepiece 110, and will tend to maintain its second stable position proximate thereto.

In order to reverse the travel of the permanent magnet 140, and in order to restore it from its second stable position proximate the electromagnet's first polepiece 110 to its first stable position substantially within the annulus of the electromagnet's second polepiece 120, an opposite, v− energization is applied to the electromagnet. Resultant to this v− energization, the force initially seen by permanent magnet 140 will be that of point 7, which is on the curve Fv−+Fk.

Note that if the spring force Fk were not operative, the energization of the electromagnet alone would not be enough to cause a negative force on permanent magnet 140 away from the electromagnet's first polepiece 110. Under the combined force of the electromagnet's second energization and the spring force the permanent magnet will move from distance $X_{min}$ to distance $X_k$ between points 7 and 8. Between points 8 and 9 the plunger 130 will come to a stop against valve seat 501 (shown in FIG. 3) and the spring 150 will thereafter be disengaged from the movement of permanent magnet 140. As the spring force becomes disengaged from the movement of the permanent magnet 140 between points 8 and 9, the forces on the permanent magnet 140 shift to the curve Fv−. Note that the forces on the permanent magnet are still negative, causing that it should move away from the electromagnet's first polepiece 110, but are of diminished magnitude. There will be some small inertial force on the moving permanent magnet 140, but this inertial force is not relied upon to ensure proper operation of the electromagnetic actuator 100.

The permanent magnet 140 will transverse from point 9 to point 10, traveling the distance between $X_k$ and $X_{max}$. The force on the permanent magnet 140 during its movement will be constantly negative, or away from the electromagnet's first polepiece 110.

At some time after the permanent magnetic has reached point 110, the v− energization of the electromagnet is turned off. At this time, the force on permanent magnet 140 will jump from curve Fv− to Fvo, or from point 10 to point 11. At point 11, the permanent magnet 140 again experiences a positive force in the direction of the electromagnet's first polepiece 110. It will "slide" from point 11 at distance $X_{max}$ back to point 1, potentially overshooting such point 12. Normally, to the limits of friction, the permanent magnet will settle in at its first stable position at point 1.

If the permanent magnet 140, and the entire electromagnetic actuator 100, is subject to shock or vibration, then these inertial forces will typically act upon the permanent magnet 140 while it is at either its first stable position point 1 or its second stable position point 6. The forces on the permanent magnet 140 at operational point 1 when there is no, i.e., vo, energization of the electromagnet serve to maintain it at its first stable position. The electromagnet 140 would have to be shocked in position all the way back to approximately 0.55" in order to lose its first stable position. The forces required to do so are not as great as will be the forces required to dislodge the permanent magnet 140 from its second stable position (to be discussed next), but would have to act at a minimum level over a long distance. Such a shock is uncharacteristic of most operational environments.

Meanwhile, the force that would be required to shock the permanent magnet 140 from its second stable position at separation $X_{min}$ and point 6 is much greater. The distance, and time, over which this force needs act is smaller, but the force need be much greater.

It should be understood by momentary reference to FIG. 3 that the force being exerted by the prime mover 130 when the permanent magnet 140 is at its first stable position (points 1, 12) is not zero. Rather, the force being exerted by the prime mover 130 is that which is developed by the spring 150 at separation $X_k$. As may be noted at point 8, this force is considerable. Therefore it is also difficult to dislodge the prime mover 130 from the position that it assumes when the permanent magnet 140 is at the first stable position (point 1).

The effect of electrical (magnetic) and mechanical tolerances on the operation of the preferred embodiment of an electromagnetic actuator 100 in accordance with the present invention are diagrammed in FIG. 4*d*. There is a tolerance both above, and below, the normal curves of the magnetic and (in a limited operational range) spring forces under which the permanent magnet 140 moves. There are other mechanical tolerances in the construction of actuator 100 that reflect upon the distances at which forces are variously encountered, and thus upon the magnitude of the encountered forces.

The design of the actuator 100 is best approached through its operational curves. Working from the forces that need to be produced in each of the stable positions, and possibly also from the forces that are desirably produced during movement between the stable positions, the strength, and relative strength, for the magnetic fields of each of the permanent magnet 140 and the electromagnet 300 may be chosen. After the performance of the permanent magnet and electromagnet 300 curves become empirically known, as shown in FIGS. 4*a* and 4*b*, a spring force may be chosen, and a dimensional region over which such spring force will be operative may be specified.

It is possible to specify an electromagnetic actuator 100 that will operate reliably at extreme high efficiency. In particular, the preferred embodiment of electromagnetic actuator 100 as shown in FIGS. 1 and 3—the performance of which is graphed in FIGS. 4*c* and 4*d*—is micropowered. The moveable elements of the actuator consisting of plunger 130 and permanent magnet 140 preferably weigh approximately one-half gram. The permanent magnet 140 is preferably made of Samarian cobalt. It moves approximately 0.38 mm (0.015 inches) in either of two directions between two stable positions in response to a 0.015 amperes, 1.5 v.d.c., 20 millisecond duration current pulse ($4.5\times10^{-4}$ watt-seconds, or joules) of appropriate polarity. The nominal minimum distance of separation of permanent magnet 140 from the electromagnet's first polepiece 110 $X_{min}$ is approximately 0.028". The maximum distance of separation $X_{max}$ is approximately 0.088". The spring 150, and spring force, is operative over the distance $X_k$ equals approximately 0.039" to distance $X_{min}$ equals approximately 0.028". The path of the mechanical movement of plunger 130 and permanent magnet 140 may be up to 0.004" off from the true magnetic axis established by the electromagnet 300.

The force of the spring 150 on the plunger 130 when the permanent magnet 140 is at its first stable position is approximately 20±0.5 grams. Even if the plunger 130 itself, exclusive of permanent magnet 140, were considered to weigh one-half gram, then this would give a resistance to displacement by shock of 20±1 grams/0.5 grams, or 40±2 g's. The net force on the plunger 130 and permanent magnet 140 when the permanent magnet is at its second stable position proximate to the electromagnet's first polepiece 110 is also approximately 20±1 grams. This again gives a resistance of the actuator 100 to shock of 40±2 g's at this point. The preferred embodiment of an actuator 100 in accordance with the present invention that is micropowered thusly not only operates to assume each of its two stable positions under extremely minute power, but will stably hold each of these positions once achieved.

The efficiency of the actuator 100 may be calculated as the definition:

$$\text{Efficiency} = \frac{\text{Work}}{\text{Energy}}$$

The work performed by the actuator 100 may be calculated, in consideration that the force of spring 150 is at all regions greater than 20 grams, as follows:

$$\begin{aligned}\text{Work} &= \text{force} \cdot \text{distance}\\ &= 9.797\times10^{-3}\,\frac{\text{N}}{g}\cdot 20\text{ g}\times 381\times10^{-6}\text{ M}\\ &= 7.47\times10^{-5}\text{ N}\cdot\text{M}\end{aligned}$$

The energy consumption may be calculated as follows:

$$\begin{aligned}\text{Energy} &= \text{power}\cdot\text{time}\\ &= .015\text{ amperes}\cdot 1.5\text{ v.d.c}\cdot 2\times10^{-2}\text{ sec}\\ &= 4.5\times10^{-4}\text{ joules}\end{aligned}$$

The efficiency may thus be calculated as follows:

$$\begin{aligned}\text{Efficiency} &= \frac{\text{Work}}{\text{Energy}}\times100\%\\ &= \frac{7.47\times10^{-5}\text{ N}\cdot\text{M}}{4.5\times10^{-4}\text{ J}}\times100\%\\ &= .166\,\frac{\text{N}\cdot\text{M}}{\text{J}}\times100\% = 16.6\%\end{aligned}$$

This efficiency is approximately ten times (×10) better than a typical state of the art solenoid device, although it cannot be assured that an actuator in accordance with the present invention will necessarily, or in all cases, be more efficient than a solenoid or other previous prime movers.

There are, however, a good number of reasons to believe that the potential efficiency of devices in accordance with the present invention can be much better than prior solenoid devices, possibly as much as twenty or thirty times better. First, the preferred embodiment actuator device in accordance with the present invention will operate reliably with increased plunger movement of 0.51 mm (0.020 inches) on a reduced current of 0.010 amperes current at a reduced voltage of 1.0 v.d.c. for the same $2\times10^{-2}$ seconds. The energy used may thusly be as low as $2\times10^{-4}$ joules, and the efficiency on the order of 0.50 NM/J×100%=50%. This efficiency is approximately thirty times better than prior art devices. The reasons that the nominal useful movement is 25% less than 0.51 mm or 0.38 mm, that the actuation current is 50% over 0.010 amperes, and that the nominal actuation voltage is 50% over 1.0 v.d.c., have to do with (i) possible aging and/or other variations in the power supply circuits external to the actuator, (ii) possible contamination of the valve seat and/or (iii) extreme long term aging and wear of the actuator, on the order of years and millions of cycles. Just as the mechanical design of the preferred embodiment of the actuator is conservative, so also is the electrical design.

Second, the efficiency, and the magnetic gain, of the preferred embodiment of an actuator in accordance with the present invention suffers from the presence, and thickness, of the plastic cylindrical tube, or sleeve, in the region between the permanent magnet and the second, annular ring, polepiece. It should be understood that the plastic sleeve, which is appropriately robust and strong, is present only to isolate the electrical sections of the actuator from fluid water. It need not be present during use of the actuator in a dry environment. (Any necessary mechanical guidance to the permanent magnet may be provided by the second polepiece itself, and intervening material need not extend into the annular opening of the second polepiece.) For optimum gain, and operational efficiency, the spacing between the permanent magnet and the interior circumferential walls of the annulus of the second polepiece should be minimal. Optimization in this area and others (such as reduction of frictional forces) might potentially produce an actuator that is even more efficient than the preferred embodiments taught within this specification.

In all cases of assessing efficiency, it must be remembered that actuators in accordance with the present invention are (i) bidirectional, and (ii) exhibit good retention forces at each of two stable positions. In many applications these attributes are more important than efficiency.

Between (i) the spring, (ii) the preferred non-linearity of the spring, and (iii) the preferred limited region over which the spring is operative to affect forces on the plunger 130 of the preferred embodiment of an electromagnetic actuator 100 in accordance with the present invention, it may be somewhat difficult to assess the minimal requirements for an actuator 100. It may also be difficult to understand the effects that the spring force, and the preferably limited region of its application, have on the performance of the electromagnetic actuator 100.

Figure 4E:
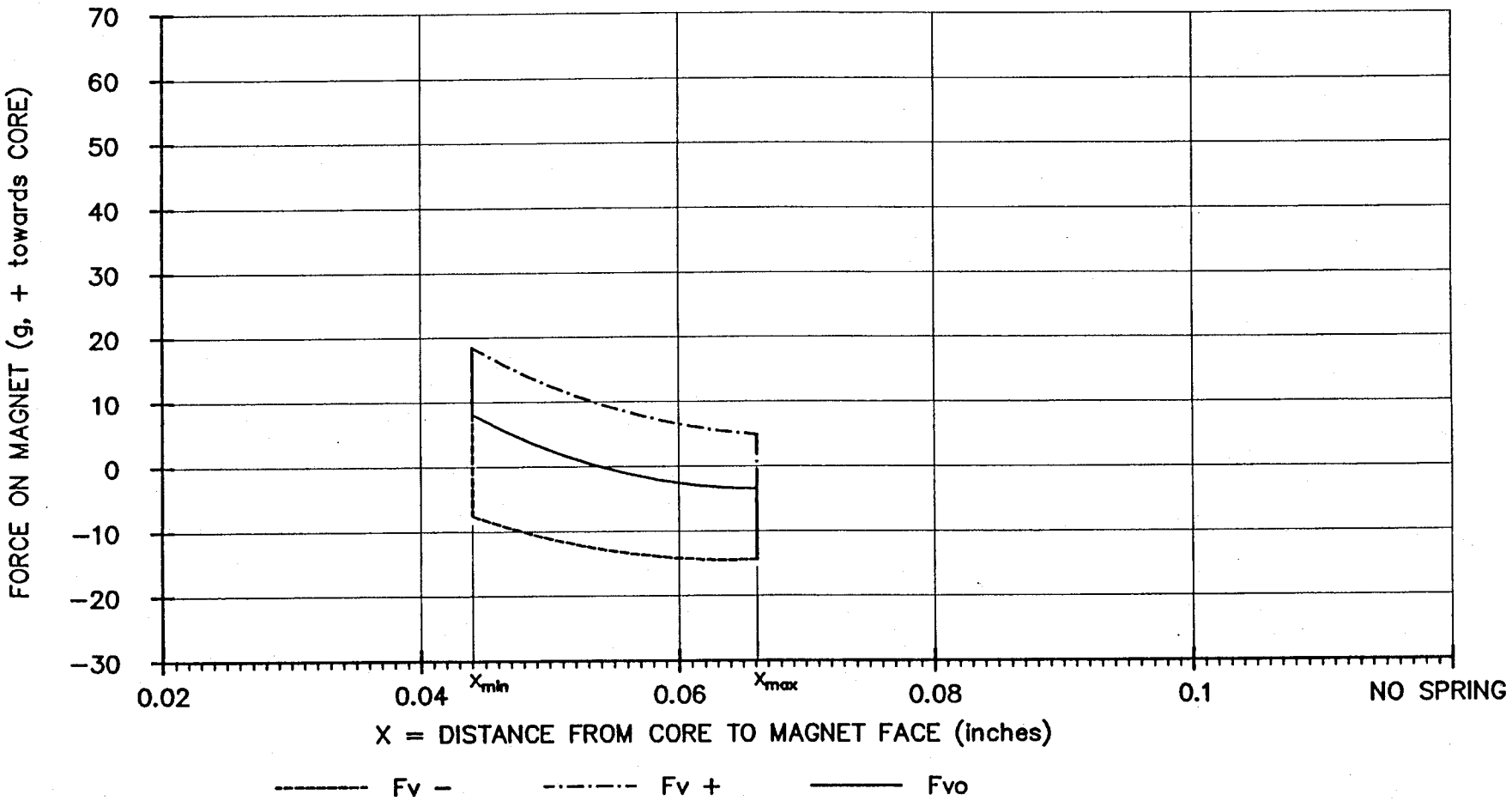
FIG. 4*e* is a graph showing the performance of a rudimentary, non-preferred, actuator in accordance with the present invention that does not employ a spring.
Figure 4F:
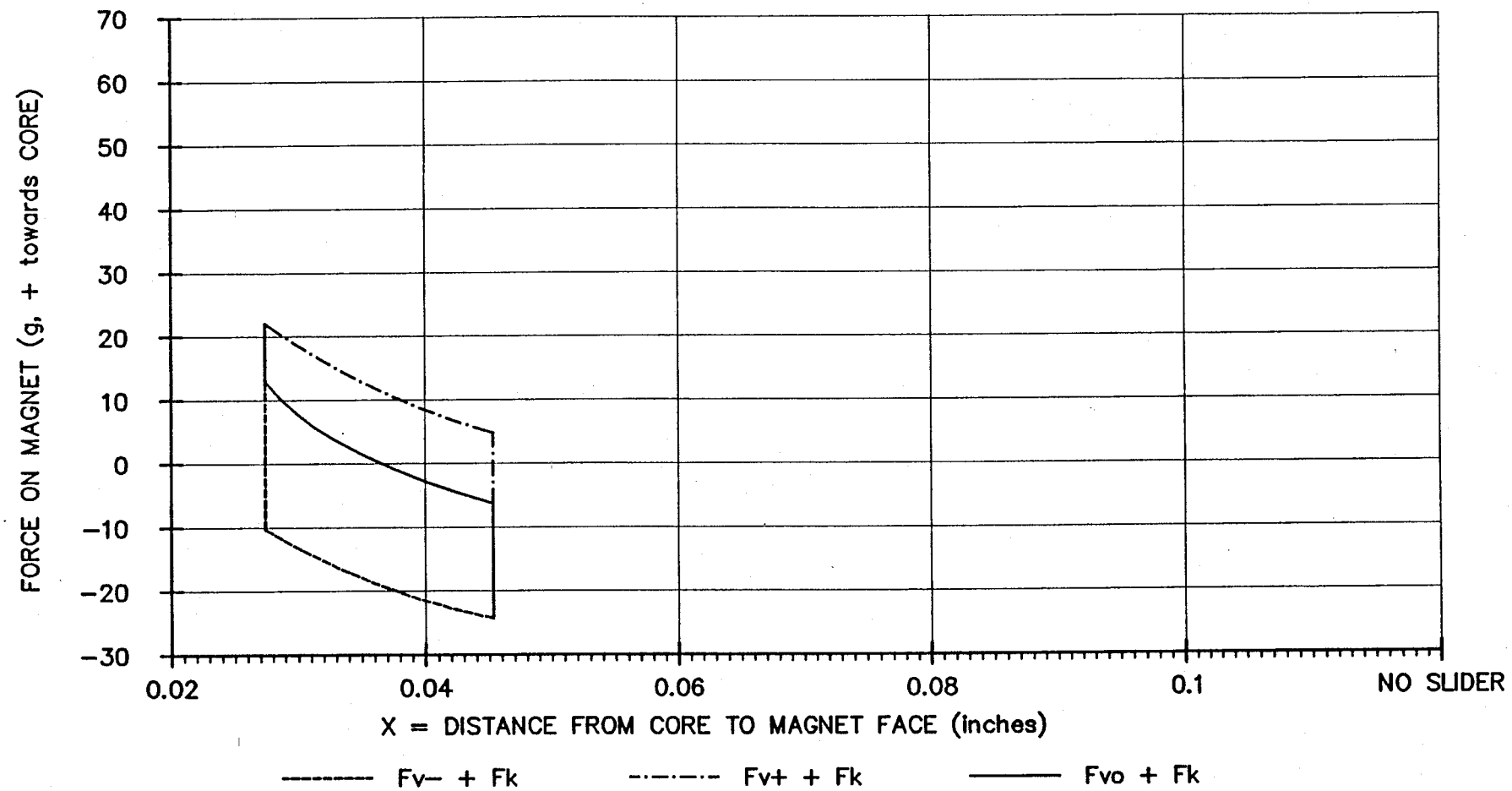
FIG. 4*f* is a graph showing the performance of another rudimentary, non-preferred, embodiment of an actuator in accordance with the present invention that does not employ a plunger, or slider, for housing the permanent magnet and for interacting with the motion thereof.

Accordingly, an operational curve for a first rudimentary embodiment of an actuator 100 in accordance with the present invention that does not employ a spring is diagrammed in FIG. 4*e*. An operational curve for a second rudimentary embodiment of an actuator in accordance with the present invention that does employ a spring, but which does not limit the region of its force application, is shown in FIG. 4*f*. Both the curves of FIG. 4*e* and FIG. 4*f* diagram the performance of electromagnetic actuators that are fully operative to move a permanent magnet within the field of an electromagnet, substantially as diagrammed in FIG. 2. However, the operational ranges of the rudimentary embodiments of the actuator are not optimally broad both in (i) distance traversed, and (ii) tolerances to electric (magnetic) and mechanical deviations. The path shown in FIG. 4*c* that is traced by the preferred embodiment of the electromagnetic actuator 100 in accordance with the present invention shows (i) a greater distance of travel, and (ii) greater forces at both its stable positions and during its course of travel, than do the less sophisticated, rudimentary, actuator embodiments that are diagrammed in FIG. 4*e* and FIG. 4*f*.

After the extensive showings of FIG. 4, the reader might understandably surmise that his or her comprehension of the actuator was complete, and that no subtleties to its realization or application remain. Because the actuator in accordance with the present invention is a wholely new electromagnetic device, this supposition would likely be wrong: the actuator accords several different, and unique, operational modes. To explain these modes, still another diagram is useful.

Figure 5:
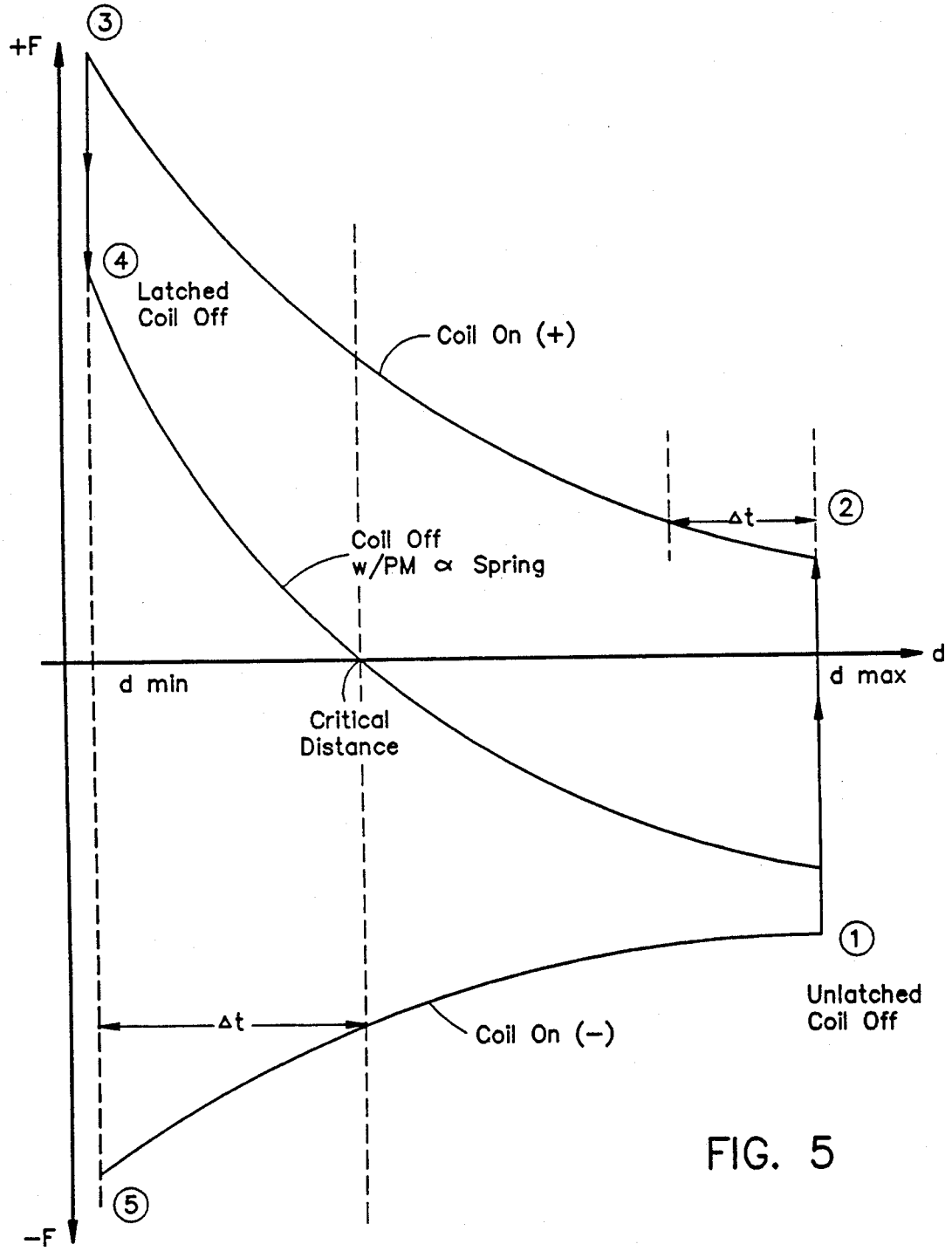
FIG. 5 is a simplified graph, similar to FIG. 4*c*, of the operational state diagram of a rudimentary, plungerless but spring-loaded, actuator in accordance with the present invention, the simplified diagram being particularly so that the times of flight, and the critical point, of the moving permanent magnet of the rudimentary actuator may be considered.

FIG. 5 shows a simplified state diagram, similar to FIG. 4*c*, of a rudimentary actuator in accordance with the present invention that has no plunger (the moving permanent magnet being the prime mover), but does have a spring (the spring forces are not separately plotted). The bidirectional operation of the actuator between stable states 1 and 4 where the permanent magnet is respectively at distances $d_{min}$ and $d_{max}$ from the first polepiece will be recognized. FIG. 5 makes clear two phenomena of actuator operation. First, there is a CRITICAL DISTANCE, somewhere between $d_{min}$ and $d_{max}$, in either direction from which the permanent magnet will either slide off (when the electromagnet's coil is not energized) to assume either stable position 1, or else stable position 4.

Second, the accelerations, and the distances traveled per unit time, of the permanent magnet are not everywheres the same while the permanent magnet is moving under force of equal energization of the electromagnetic coil. This is particularly illustrated by the equal time intervals $\Delta t$ that are marked off in FIG. 5. In attempting to transition from point 5 to point 1 a pulse of duration $\Delta t$ will move the permanent magnet to the critical point. A still longer pulse will cause, when energization is removed, that the permanent magnet will continue past the critical point to proceed to point 1.

Meanwhile, an equal duration pulse $\Delta t$ will cause only slight displacement of the permanent magnet from point 2 towards point 3. An energizing pulse of this duration, or slightly longer, will not suffice to change the state of the actuator.

Accordingly, multiplexed operation of two actuators showing (normally back-to-back) a single electromagnetic coil is possible. A pulse of a given duration will be sufficient to cause the electromagnet to change in a one direction between stable positions, but not in the opposite direction. The principle holds true even if a plunger contains the moving permanent magnet.

A time-of-flight analysis of the moving permanent magnet taken by reference to FIG. 5 will soon lead to an understanding that energizations of the electromagnet's coil at certain voltages and currents, and/or for certain durations of time, may be variously sufficient or insufficient to cause the actuator to change state. The actuator is likely somewhat "unbalanced" in its energization requirements, and can intentionally be made more so (such as by adjustment of the spring force).

If two "unbalanced" actuators are arranged back-to-back to share the same electromagnetic coil, and if the polarities of the permanent magnets are made to be in the same sense along the longitudinal axis of the combined actuators (so that a first actuator assumes a first stable position under the same energization causing the second actuator to assume a second opposite, stable, position) as is shown in FIG. 1, then it is possible to realize independently-controlled, multiplexed, double-ended operation of the combined actuators. This means that each end of the back-to-back actuators can be independently controlled through the same, shared, coil by the simple expedient of controlling the magnitude and/or the length of the pulsed electrical energization applied to the coil. For example, consider the control of two back-to-back actuators each of which requires a longer energizing pulse (i.e., more energization) to "pull in" than to "push out". This control is summarized in the following Table 1.

TABLE 1

| Energization | State of First Actuator | State of Second Actuator |
|---|---|---|
| (no energization, initial conditions) | (out) | (out) |
| +long pulse | remains out | pulls in |
| −short pulse | remains out (perturbed only) | pushes out |
| −long pulse | pulls in | remains out |
| −short pulse | pushes out | remains out (perturbed only) |

The operation can be entirely reversed by using two back-to-back actuators each of which requires a longer energizing pulse to "push out" then to "pull in". This control is summarized in the following Table 2.

TABLE 2

| Energization | State of First Actuator | State of Second Actuator |
|---|---|---|
| (no energization, initial conditions) | (in) | (in) |
| +long pulse | remains in | pushes out |
| −short pulse | remains in | pulls in |
| −long pulse | pushes out | remains in |
| +short pulse | pulls in | remains in |

The actuators in accordance with the present invention are thus extremely flexible and versatile to produce pushing and pulling mechanical motion, including in (i) double-ended non-mechanically phase-locked (and inverse phase-locked), and (ii) double-ended independently-controllable multiplexed configurations.

The double-ended actuator configurations are distinguished over previous double acting dual solenoids for employing one, and not two, coils. The present actuators correspondingly use less material, are less voluminous, and are more efficient. Full bidirectional control is obtained by only two wires versus the previous three wires. (If diodes were to be used with previous dual solenoids in order to permit two wire, polarity-sensitive, control then efficiency would be reduced.)

Still further analysis of the actuators in accordance with the present invention may prove possible by analogy of the operation of such actuators to bipolar or field effect transistors, or to other electronic devices. An electron device model of the actuator in accordance with the present invention might particularly be attempted to quantitatively predict actuator performance based on varying parameters of actuator construction.

The actuator in accordance with the present invention is so significantly different, and differently-acting, then a previous solenoid device that certain performance attributes of both devices that may be usefully contrasted might tend to be overlooked. The plunger, or prime mover, within the actuator of the present invention does not move within the electromagnet's coil, unlike a conventional solenoid. This is particularly important for valve applications because the working fluid can easily be completely separated from the electromagnetic components without undesirably increasing the distance by which the inner windings of the electromagnet's coil are separated from its core.

The actuator in accordance with the present invention benefits from having a plunger of low mass. In a conventional solenoid, the plunger is a high permeability rod or bar that is substantially equal in length to the electromagnetic coil. This should be contrasted with the relatively smaller, relatively lower mass, plunger (including the permanent magnet) of the actuator of the present invention. The use of a longer, smaller diameter electromagnetic coil in a conventional solenoid in order to increase electromagnetic efficiency is accomplished by an undesirable proportional increase in the mass of the plunger. This mass increase slows actuation speed. If a secondary latching mechanism in the form of an added mechanical, or magnetic "over-center", mechanism is employed with a solenoid to crate a latching solenoid then the higher plunger mass results in a tendency for it to become dislodged from its latched position by shock (acceleration) in the direction of the electromagnet coil's axis.

The relatively longer, relatively more massive, plunger of a conventional solenoid also suffers from relatively larger mechanical friction and/or binding effects on its movement. This friction and/or binding experienced by a conventional solenoid plunger is not experienced with just one end polepiece, as is the case with the plunger within the actuator of the present invention, but is additionally experienced with the coil through which the conventional plunger must slide. If the solenoid is employed in a valve application, the long engagement of its plunger into its coil also tends to produce high viscous damping forces, further impeding the quick movement of the plunger and reducing the efficiency of its movement.

In accordance with the preceding explanation, the present invention will be recognized not merely to theoretically switch a relatively larger field of a permanent magnet with a relatively smaller field of an electromagnet, but to also embody many preferred aspects of construction. Certain shapes, proportion, and spacings of the permanent magnet and both polepieces are preferred. Spring forces are preferably applied over a limited distance. These numerous specific characteristics create, in aggregate, an electromagnetic actuator that is both (i) producible, and (ii) possessed of performance characteristics that besuit real world applications. These applications may be anything to which an electromagnetic prime mover is normally employed, and may particularly include an electromagnetic valve.

Actuators in accordance with the present invention permit useful mechanical drive, whether for valve actuation or other purposes, by power and current drive levels that are obtainable with CMOS and other standard logic circuitry. Actuators in accordance with the present invention may be built to operate with voltages so low as to effectively preclude spark generation—thereby permitting the construction of unshielded and unenclosed mechanical actuators for use in explosive environments. Finally, the low power actuators in accordance with the present invention are potentially actuable by biologically generated electromagnetic potentials—thereby facilitating the implementation of biomedical devices.

In accordance with the preceding discussion, certain adaptations and alterations of the present invention will present themselves to a practitioner of the mechanical arts. Once the concept of adjusting the movement of the actuator by a spring force that is applied over a limited region is recognized, it is a logical extension of the concept to employ a plurality of springs each of which is operative over an individually associated region, or a suitably designed non-linear spring. In this manner the force versus distance curves of the actuator may be somewhat smoothed.

It is also possible to segment the permanent magnet into various portions which act against associated detents in order each to travel to varying minimum distances in proximity to the electromagnet's first polepiece. Various parts of the collective permanent magnet remain at varying distances of separation from the polepiece. The magnet pieces separate, and come together again, as the actuator assumes its first and second stable positions.

It is still further possible to use kinetic, and inertial, effects during operation of electromagnetic actuators in accordance with the present invention. The analysis of these effects, and the use of such effects in the design of actuators, is generally complex. However, for some actuators employing extremely long distances of operation and/or extremely high speeds, consideration of inertial effects may be useful in optimization of actuator design.

In accordance with the preceding discussion, the present invention of an electromagnetic actuator should be perceived broadly, in accordance with the language of the following claims, only, and not solely in accordance with that particular preferred embodiment within which the actuator has been taught.

What is claimed is:

1. An electromagnetic actuator for converting an electrical current to a mechanical force comprising:

an electromagnet having a first polepiece and a second polepiece separated by a gap, said electromagnet being energizable by a first-direction electrical current to produce a first-type magnetic pole at its first polepiece, a second-type magnetic pole at its second polepiece, and a first electromagnetic field therebetween;

a permanent magnet having a second-type permanent magnetic pole oriented towards the electromagnet's first polepiece, a first-type permanent magnetic pole oriented oppositely, and a magnetic field therebetween, said permanent magnet being situated in the gap and being movable therein from a first position proximate the electromagnet's second polepiece where the magnetic field substantially shunts this second polepiece to a second position proximate the electromagnet's first polepiece where the magnetic field substantially shunts this first polepiece, said permanent magnet producing by such movement a first mechanical force in the direction towards the electromagnet's first polepiece.

2. The electromagnetic actuator according to claim 1 wherein said electromagnet is further energizable by a second-direction electrical current to produce a second-type magnetic pole at its first polepiece, a first-type magnetic pole at its second polepiece and a second electromagnetic field therebetween;

said permanent magnet being further moveable from the second position to the first position in response to the second electromagnetic field, said permanent magnet producing by such movement a second mechanical force in the direction away from the electromagnet's first polepiece.

3. The electromagnetic actuator according to claim 2 further comprising:

means for biasing said permanent magnet along an axis of its movement from its second to its first position.

4. The electromagnetic actuator according to claim 3 wherein the said biasing means biases the permanent magnet in the direction of its movement from the second to the first position.

5. The electromagnetic actuator according to claim 3 wherein the means for biasing comprises:

a spring.

6. The electromagnetic actuator according to claim 5 further comprising:

a stop means for limiting said spring to bias the movement of said permanent magnet only over a range of movement that is proximate to said magnet's second position and does not extend so far as said magnet's first position.

7. An electromagnetic actuator comprising:

an electromagnet substantially in the shape of a pot electromagnet having an outer, second, polepiece extended radially inwards until terminating proximately and substantially perpendicular to the butt end of an inner, first, polepiece, the electromagnet being energizable by an electrical current to produce an electromagnetic field in a gap between its first polepiece and its second polepiece; and a permanent magnet, located in the gap and having its magnetic poles oriented towards the electromagnet's polepieces, the permanent magnet being moveable in response to the electromagnetic field between a first position proximate the electromagnet's second polepiece and a second position the electromagnet's first polepiece, the permanent magnet providing by such movement a motive force.

8. The electromagnetic actuator according to claim 7 wherein the electromagnet is energizable by electrical currents of opposite direction to produce electromagnetic fields of opposite magnetic polarity in the gap; and wherein the permanent magnet is moveable bidirectionally between the first and the second positions in response to the electromagnetic fields of opposite polarity.

9. The electromagnetic actuator according to claim 8 wherein the moveable permanent magnet is coupled by its own magnetic flux to the proximate second polepiece at its first position, and to the proximate first polepiece at its first position, and to the proximate first polepiece at its first position, so that, by this magnetic flux coupling, the permanent magnet forcibly resists movement from its first, or its second, position when the electromagnet is not energized.

10. The electromagnetic actuator according to claim 7 further comprising:

biasing means for force biasing at least a portion of the movement of the permanent magnet between its first and its second positions.

11. The electromagnetic actuator according to claim 10 wherein the biasing means force biases the movement of the permanent magnet in a direction from its second to its first position.

12. The electromagnetic actuator according to claim 11 wherein the biasing means force biases the movement of the permanent magnet over a portion of its movement path including its second position but not including its first position.

13. An electromagnetic actuator for converting electrical current to mechanical force comprising:

an electromagnet having first and second polepieces and a gap therebetween, said electromagnet being responsive to a first current flowing in a first direction to produce an electromagnetic flux in a first direction in the gap between its first and second polepieces, and being responsive to a second current flowing in an opposite second direction to produce an electromagnetic flux in an opposite second direction between the first and second polepieces;

a permanent magnet, magnetically coupled to the electromagnet and producing a magnetic flux that is superimposed on the electromagnetic flux in the gap, said permanent magnet being responsive to electromagnetic flux in the first direction for first switching the path of its magnetic flux from (i) shunting the second polepiece relatively more than the first polepiece to (ii) substantially aligning with the path of the electromagnetic flux to substantially pass through both polepieces, the permanent magnet moving in response to this first flux switching from (i) a first stable position proximate the second polepiece to (ii) a second stable position proximate the first polepiece, and also being responsive electromagnetic flux in the second direction for second switching the path of its magnetic flux from (iii) shunting the first polepiece relatively more than the second polepiece to (iv) substantially aligning with the path of the electromagnetic flux to substantially pass through both polepieces, the permanent magnet moving in response to this second flux switching from (iii) the second stable position to the (iv) first stable position.

14. The electromagnetic actuator according to claim 13 further comprising:

spring means for biasing at least part of the permanent magnet's movement between its first and its second stable positions.

15. The electromagnetic actuator according to claim 14 wherein the spring means comprises:

a spring biasing the permanent magnet in the direction from its second stable position toward its first stable position.

16. The electromagnetic actuator according to claim 14 further comprising:

limiting means for limiting the biasing of the permanent magnet's movement to occur only along a proximate to a one of its first and its second stable positions.

17. The electromagnetic actuator according to claim 16 wherein the limiting means limits the biasing of the permanent magnet's movement to occur only proximate to the second stable position.

18. The electromagnetic actuator according to claim 17 wherein the spring means comprises:

a spring for biasing the permanent magnet in the direction from its second stable position toward its first stable position.

19. The electromagnetic actuator according to claim 17 wherein the spring exerts a relatively greater biasing force relatively closer to the second stable position.

20. The electromagnetic actuator according to claim 13 wherein the permanent magnet has its magnetic poles aligned substantially along the axis of its movement.

21. The electromagnetic actuator according to claim 20 wherein the electromagnet-induced first magnetic flux in the first direction makes the electromagnet's first polepiece to be of opposite magnetic polarity to that magnetic pole of the permanent magnet to which it is most closely proximate; and wherein the electromagnet-induced first magnetic flux in the second direction makes the electromagnet's first polepiece to be of the same magnetic polarity to that magnetic pole of the permanent magnet to which it is most closely proximate.

22. An electromagnetic actuator for converting electrical energy to mechanical motion comprising:

an electromagnet having (i) a first polepiece exhibiting a longitudinal axis and (ii) a second polepiece aligned substantially perpendicular to the longitudinal axis and positionally separated a short distance from the first polepiece so as to define a gap therebetween, said electromagnet being responsive to directional energizing currents for producing an electromagnetic flux in the gap in a first direction in response to a first-direction energizing current and in a second direction in response to a second-direction energizing current;

a two-pole permanent magnet positioned in the gap with its magnetic poles substantially aligned along the longitudinal axis for producing a magnetic flux superimposed upon the electromagnetic flux, said permanent magnet being reciprocally moveable in the gap along the longitudinal axis in response to the electromagnetic flux in the gap between (i) a first position relatively closer to the second polepiece and relatively further from the first polepiece, and (ii) a second position relatively further from the second polepiece and relatively closer to the first polepiece, said permanent magnet being moveable from its first position to its second position in response to the electromagnetic flux in the first direction and being moveable from its second position to its first position in response to the electromagnetic flux in the second direction; and biasing means disposed between the first polepiece and the electromagnet for biasing the permanent magnet to move away from the first polepiece of the electromagnet in a direction along the longitudinal axis.

23. The electromagnetic actuator according to claim 22 wherein the permanent magnet is stably held in each of its first and its second positions in the absence of any electromagnetic flux in the gap because its magnetic flux respectively shunts the closer second, and the closer first, polepieces of the electromagnet.

24. The, electromagnetic actuator according to claim 23 further comprising:

a plunger coupled to the permanent magnet for moving therewith over at least a portion of its reciprocal movement between its first and its second stable positions in order to serve, by such movement, as a prime mover.

25. The electromagnetic actuator according to claim 24 wherein the plunger comprises:

a plunger body defining a cavity containing the permanent magnet and permitting the reciprocal movement thereof along the longitudinal axis within the cavity, the cavity being of a length and in a position relative to the reciprocal movement path of the permanent magnet so as to permit the permanent magnet to move away from its first stable position and toward the first polepiece entirely within the cavity before engaging an end of the cavity to thereafter move the entire plunger body as the permanent magnet completes its movement to its second stable position.

26. The electromagnetic actuator according to claim 25 wherein the biasing means comprises:

a spring, connected between the electromagnet and the plunger body, for biasing the plunger body away from the first polepiece of the electromagnet, and also for biasing the permanent magnet contained within the cavity of the plunger body away from the first polepiece of the electromagnet when the permanent magnet is in contact with that end of the plunger body's cavity that is towards the first polepiece.

27. The electromagnetic actuator according to claim 22 wherein the electromagnet's first polepiece is substantially in the shape of the butt end of a substantially cylindrical body.

28. The electromagnetic actuator according to claim 27 wherein the electromagnet's second polepiece is substantially in the shape of an annular ring.

29. The electromagnetic actuator according to claim 28 wherein the permanent magnet is substantially in the form of a cylinder.

30. The electromagnetic actuator according to claim 29 wherein the interior diameter of the annulus of the electromagnet's second polepiece is approximately equal to the exterior diameter of the substantially cylindrical permanent magnet.

31. The electromagnetic actuator according to claim 30 wherein the thickness of the electromagnet's second polepiece substantially in the shape of an annular ring is approximately equal to the length of the permanent magnet substantially in the shape of a cylinder.

32. The electromagnetic actuator according to claim 31 wherein the distance by which the electromagnet's first polepiece is separated from its second polepiece is less than the length of the substantially cylindrical permanent magnet.

33. An electromagnetic actuator for converting electrical energy to mechanical force comprising:

an electromagnet having first and second polepieces defining a gap therebetween, the electromagnet being responsive to energizing currents flowing in opposite directions for producing an electromagnetic flux of a corresponding direction in the gap;

a permanent magnetic, magnetically coupled to the electromagnet and producing a magnetic flux in the gap, the permanent magnet (i) substantially shunting with its magnetic flux a one of the first and the second polepieces to which it is proximate upon such times as no energizing current flows in the electromagnet, (ii) being responsive to a change in the electromagnetic flux in a first direction for switching its magnetic flux from substantially shunting one polepiece to instead substantially aligning with a path of the electromagnetic flux and substantially passing through both polepieces, and (iii) being responsive to a change in the electromagnetic flux in an opposite second direction for again switching its magnetic flux from substantially shunting one polepiece to instead substantially aligning with the path of the electromagnetic flux and substantially passing through both polepieces;

wherein the (i) substantially shunting of magnetic flux causes the permanent magnet to be retained at whatsoever one of the first and the second polepieces to which it is then proximate, while the (ii) and the (iii) flux switching exert electromotive forces to move the permanent magnet between a first stable position proximate the first polepiece and a second stable position proximate the second polepiece.

34. The electromagnetic actuator according to claim 33 further comprising:

a plunger defining a cavity containing the permanent magnet; and a spring connected between the electromagnet and the plunger for biasing the plunger, and also for biasing the permanent magnet contained within the plunger's cavity when the permanent magnet is positioned against an end wall of the plunger's cavity by its movement, which movement of the permanent magnet is relative to the plunger and its cavity as well as to the electromagnet and to its polepieces.

35. An electromagnetic actuator for converting electrical energy to mechanical force comprising:

a modified pot electromagnet having (i) a coil substantially in the form of a cylinder having a hollow central bore and two end sides, and(ii) a flux permeable member proceeding in a nearly closed path passing through the cylindrical coil's central bore, along its first end side, along the outside of the cylinder, and, as the substantial modification, further along a second end side until a short gap is presented at a position adjacent the bore's first end; and a two-pole permanent magnet movably positioned in the gap and constrained for movement along an axis of the bore between positions relatively closer to and relatively further away from the bore's first end.

36. An electromagnetic actuator comprising:

a first electromagnetic polepiece having a major axis and a one butt end, the first polepiece selectively energizable as either an electromagnetic North or an electromagnetic South pole;

a second electromagnetic polepiece having a major axis substantially perpendicular to the major axis first polepiece and an end that is located adjacent to and separated by a gap from the first polepiece's butt end, the second polepiece selectively energizable as either an electromagnetic South or an electromagnetic North pole oppositely as the first electromagnetic polepiece is so energized;

a permanent magnet, having two opposite magnet poles upon a major axis that is substantially aligned with the major axis of the first polepiece, positioned in the gap between the ends of the first and the second polepieces and axially reciprocally moveable therein in each of two opposite directions dependent upon the selective energization of the first and of the second electromagnetic polepieces.

37. An electromagnetic actuator having a moving element bidirectionally moveable in each of two directions between two stable positions comprising:

an electromagnet, having first and second polepieces defining a gap therebetween, for producing, responsive an energizing current flowing in one of two directions, an electromagnetic field of a corresponding direction within the gap;

the electromagnet's first polepiece being shaped, at the region of the gap, substantially as an elongate body so as to produce lines of electromagnetic flux that enter into the gap at the first polepiece in directions substantially aligned with a longitudinal axis of the elongate body, the second polepiece being shaped, at the region of the gap, substantially as an annular ring that is oriented perpendicular to the longitudinal axis of the elongate body and spaced therefrom so as to produce lines of electromagnetic flux that enter into the gap at the second polepiece in directions substantially perpendicular to the longitudinal axis of the elongate body; and a permanent magnet, situated in and sliding within the gap and along the longitudinal axis, magnetized substantially in the direction of the longitudinal axis, and having a size and an aspect ratio relative to the gap and to the two polepieces so as to permit the permanent magnet to be located alternatively at a first position substantially within the annulus of the second polepiece and spaced apart from the first polepiece thereat to substantially shunt with its magnetic flux the second polepiece, and at a second position substantially proximate to the first polepiece thereat to substantially shunt with its magnetic flux the first polepiece.

38. An electromagnetic actuator comprising:

an electromagnet, having separated polepieces defining a gap, for selectively producing an electromagnetic field in the gap between the polepieces and a closed loop of electromagnetic flux threading both polepieces; and a permanent magnet, producing a magnetic field, for moving in the gap between separated positions where a flux of the magnetic field substantially shunts an adjacent one of the electromagnet's separated polepieces, the moving being in response to, and because, the electromagnetic field switches the magnetic flux from substantially shunting an adjacent polepiece to substantially aligning with the electromagnetic flux.

39. An electromagnetic actuator for converting an electrical current to a mechanical force comprising:

a modified pot-shaped electromagnet having an outer polepiece that is extended over the end of the electromagnet to form an annular ring, an annulus of the extended outer polepiece and a butt end of an inner polepiece combinationally defining in a gap between them a shallow cylindrical bore; and a cylindrical permanent magnet, having its magnetic poles oriented oppositely along the axis of the cylinder, inserted within the bore for moving therein;

wherein energization of the electromagnet with a first-direction current to produce a first-direction electromagnetic field causes the permanent magnet to pull forcibly inwards from a first position proximate the extended outer polepiece's annulus towards a second position proximate the inner polepiece's butt end.

40. The electromagnetic actuator according to claim 39 wherein energization of the electromagnet with a second-direction current to produce a second-direction electromagnetic field causes the permanent magnet to push forcibly outwards from its second position proximate the inner polepiece's butt end towards its first position proximate the extended outer polepiece's annulus.

41. A method of producing an electromotive force comprising:

constraining a permanent magnet having two poles oppositely disposed along a longitudinal axis for bidirectional movement in the direction of the axis between (i) a first position adjacent a second polepiece of an electromagnet and transversely oriented relative to an axis of this second polepiece, and (ii) a second position adjacent a first polepiece of the electromagnet and coaxially oriented relative to an axis of this first polepiece;

first energizing the electromagnet with a first-direction electric current to generate a first-direction electromagnet field sufficient to switch a magnetic flux of the permanent magnet from substantially shunting the second polepiece to substantially passing in a minimum reluctance path through the electromagnet, therein inducing a first electromagnetic force on the permanent magnet in an axial direction from the first to the second position.

42. The method according to claim 41 which, at a time after the first energizing, further comprises:

second energizing the electromagnet with a second-direction electric current to generate a second-direction electromagnetic field sufficient to switch the magnetic flux of the permanent magnet from substantially shunting the first polepiece to substantially passing the minimum reluctance path through the electromagnet, therein inducing a second electromotive force on the permanent magnet in an axial direction from the second to the first position.

43. A method of inducing an electromagnetic force on a permanent magnet substantially by switching its own magnetic flux with an electromagnetic flux from an electromagnet, the method comprising:

spatially positioning and orienting a first, substantially cylindrical, and a second, substantially annular, polepiece of an electromagnet so that a major axis of each is substantially perpendicular to the major axis of the other and so that each is separated from the other by a common gap, this gap being located and having an axis between a butt end of the substantially cylindrical first polepiece and an annulus of the substantially annular second polepiece;

guiding a substantially cylindrical permanent magnet, producing a magnetic flux between magnetic poles that are substantially aligned along the gap axis, to move along the gap axis between a first position, relatively more proximate the second polepiece's annulus and relatively less proximate the first polepiece's butt end, and a second position, relatively more proximate the first polepiece's butt end and relatively less proximate the second polepiece's annulus; and first energizing the electromagnet with a first direction current to generate a first-direction electromagnetic flux that switches the permanent magnet's magnetic flux from substantially shunting the second polepiece to substantially passing through the electromagnet, therein inducing a first electromotive force on the permanent magnet that is substantially a result of switching its flux.

44. The method according to claim 43 which, at a time after the first energizing, further comprises:

second energizing the electromagnetic with a second direction current to generate a second-direction magnetic flux that switches the permanent magnet's magnetic flux from substantially shunting the first polepiece to substantially passing through the electromagnet, therein inducing a second electromotive force, opposite in direction to the first electromotive force, on the permanent magnet, which force is again substantially a result of switching the permanent magnet's flux.

45. A prime mover comprising:

an electromagnet means, having when energized with electricity two electromagnetic poles, for producing when energized with electricity a first magnetic field, this first magnetic field having first lines of first magnetic flux proceeding in a first path of least magnetic reluctance between the two electromagnetic poles; and a moveable permanent magnet means, located within the first magnetic field of the electromagnet means and having itself two permanent magnetic poles, for establishing, and for maintaining without input of electrical energy, a second magnetic field, this second magnetic field having second lines of second magnetic flux proceeding, depending upon where the moveable permanent magnet means is physically located relative to the electromagnet means, in at least two different paths of least magnetic reluctance between the two permanent magnetic poles;

wherein the electromagnet means is itself located within the second magnetic field of the permanent magnet means, thereby making that each means is located within the magnetic field of the other;

wherein, responsively to electrical energization of the electromagnet means at each of two opposite polarities in order to correspondingly produce the first magnetic field in each two opposite senses, the permanent magnet means will, by interaction with its second magnetic field with the then-existing first magnetic field of the electromagnet means, move between each of two positions within the first magnetic field;

wherein when electrical energization of the electromagnet means is ceased the permanent magnet means will hold its assumed position with its second lines of second magnetic flux following an associated one of the two different paths.

46. In a prime mover device having an electromagnet having when energized with electricity two electromagnetic poles with a first magnetic field therebetween, this first magnetic field having first lines of first magnetic flux proceeding in a first path of least magnetic reluctance between the two electromagnetic poles, and a permanent magnet also having two permanent magnetic poles with a second magnetic field therebetween, this second magnetic field having second lines of second magnetic flux proceeding in a second path of least magnetic reluctance between the two permanent magnetic poles, an improvement directed to moving the permanent magnet relative to the electromagnet by switching the second path of its second magnetic flux, the improvement comprising:

the permanent magnet located so that it is free to move within a constrained region within the first magnetic field of the electromagnet, and particularly within a high-magnetic-reluctance gap region of the first path of the first magnetic flux, this location serving to simultaneously place at least a portion of the electromagnet within the second magnetic field of the permanent magnet; and the electromagnet selectively energized with each of two polarities of electricity in order to cause, upon each selective polarity energization and the production of the first magnetic field responsively thereto, that the permanent magnet should, responsively to interaction of its second magnetic field with the then-existing first magnetic field, forcibly move between each of two positions within the constrained region, this movement causing that the second path of the second magnetic flux, while still continuing to travel through a portion of the electromagnet, will change;

wherein when selective electrical energization of the electromagnet is ceased then the permanent magnet holds its assumed position with the constrained region by action of the second magnetic field.

47. A method of controlling a prime mover device having an electromagnet having when energized with electricity two electromagnetic poles with a first magnetic field therebetween, this first magnetic field having first lines of first magnetic flux proceeding in a first path of least magnetic reluctance between the two electromagnetic poles, and a permanent magnet also having two permanent magnetic poles with a second magnetic field therebetween, this second magnetic field having second lines of second magnetic flux proceeding in a second path of least magnetic reluctance between the two permanent magnetic poles, the method directed to moving the permanent magnet relative to the electromagnet by switching the second path of its second magnetic flux, the method comprising:

locating the permanent magnet so that it is free to move within a constrained region within the first magnetic field of the electromagnet, and particularly within a high-magnetic-reluctance gap region of the first path of the first magnetic flux, this location serving to simultaneously place at least a portion of the electromagnet within the second magnetic field of the permanent magnet; and selectively energizing the electromagnet with each of two polarities of electricity in order to cause, upon each selective polarity energization and the production of the first magnetic field responsively thereto, that the permanent magnet should, responsively to interaction of its second magnetic field with the then-existing first magnetic field, forcibly move between each of two positions within the constrained region, this movement causing that the second path of the second magnetic flux, while still continuing to travel through a portion of the electromagnet, will change;

wherein when selective electrical energization of the electromagnet is ceased then the permanent magnet holds its assumed position with the constrained region by action of the second magnetic field.

* * * * *